US010562335B2

(12) United States Patent
Prett et al.

(10) Patent No.: US 10,562,335 B2
(45) Date of Patent: Feb. 18, 2020

(54) METHOD FOR THE SURFACE APPLICATION OF A SECURITY DEVICE OVER A PAPER MACHINE MADE HOLE

(71) Applicant: Crane & Co., Inc., Boston, MA (US)

(72) Inventors: Giles D. Prett, Dalton, MA (US); Manish Jain, Pittsfield, MA (US); Kraig M. Brigham, Lenox, MA (US)

(73) Assignee: Crane & Co., Inc., Boston, MA (US)

( * ) Notice: Subject to any disclaimer, the term of this patent is extended or adjusted under 35 U.S.C. 154(b) by 102 days.

(21) Appl. No.: 15/842,142

(22) Filed: Dec. 14, 2017

(65) Prior Publication Data

US 2018/0104976 A1 Apr. 19, 2018

Related U.S. Application Data

(63) Continuation-in-part of application No. 15/041,800, filed on Feb. 11, 2016, now Pat. No. 10,189,292.
(Continued)

(51) Int. Cl.
*B42D 25/48* (2014.01)
*B42D 25/24* (2014.01)
(Continued)

(52) U.S. Cl.
CPC ..... *B42D 25/48* (2014.10); *B42D 25/24* (2014.10); *B42D 25/29* (2014.10); *B42D 25/324* (2014.10); *B42D 25/333* (2014.10); *B42D 25/355* (2014.10)

(58) Field of Classification Search
USPC ..... 162/140
See application file for complete search history.

(56) References Cited

U.S. PATENT DOCUMENTS 4,534,398 A * 8/1985 Crane ..... D21F 1/44 162/103
2004/0065743 A1 4/2004 Doublet
(Continued)

FOREIGN PATENT DOCUMENTS

EP 1931827 A1 6/2008
GB 2103669 A 2/1983
(Continued)

OTHER PUBLICATIONS

Notification of Transmittal of the International Search Report and the Written Opinion of the International Searching Authority, or the Declaration dated Mar. 1, 2019 in connection with International Patent Application No. PCT/US2018/065807, 10 pages.
(Continued)

*Primary Examiner* — Mark Halpern

(57) ABSTRACT

A sheet material having a security device applied over a paper machine made or 'soft-edged' through-hole and a method for preparing such a sheet material is provided. The through-hole(s) is formed in a forming fibrous web before it becomes sufficiently consolidated and then the security device is applied onto the fibrous web and preferably over the through-hole(s) at or near a couch roll or similar tool of a paper machine when the fibrous web constitutes a sufficiently consolidated, fully formed wet web. Moreover, papers made in accordance with the inventive method, when subjected to the Circulation Simulation Test, showed minimal damage at the paper/security device interface. Further, the surface-applied security devices showed acceptable levels of intaglio ink adhesion, and the papers had higher cross-direction (CD) tensile strength and much less show-through on opposing sides thereof.

19 Claims, 11 Drawing Sheets

Related U.S. Application Data

(60) Provisional application No. 62/114,699, filed on Feb. 11, 2015.

(51) Int. Cl.

| | |
|---|---|
| ***B42D 25/355*** | (2014.01) |
| ***B42D 25/333*** | (2014.01) |
| ***B42D 25/324*** | (2014.01) |
| ***B42D 25/29*** | (2014.01) |

(56) References Cited

U.S. PATENT DOCUMENTS

| | | | |
|---|---|---|---|
| 2005/0224203 | A1 | 10/2005 | Boehm et al. |
| 2007/0164555 | A1 | 7/2007 | Mang et al. |
| 2009/0243278 | A1 | 10/2009 | Camus et al. |
| 2011/0056638 | A1 | 3/2011 | Rosset |
| 2016/0229215 | A1 | 8/2016 | Prett et al. |

FOREIGN PATENT DOCUMENTS

| | | | |
|---|---|---|---|
| GB | 2395724 | A | 6/2004 |
| GB | 2433470 | A | 6/2007 |
| RU | 2538512 | C2 | 1/2015 |
| WO | 03055683 | A1 | 7/2003 |
| WO | 2005/052650 | A2 | 6/2005 |

OTHER PUBLICATIONS

Office Action dated Jun. 4, 2019 in connection with Russian Patent Application No. 2017131383/05, 13 pages.

Examination report dated Apr. 30, 2019 in connection with Australian Patent Application No. 2016219187, 3 pages.

Office Action dated Jun. 26, 2019 in connection with Indonesia Patent Application No. P00201705982, 4 pages.

National Intellectual Property Administration, P.R. China, "First Office Action," Application No. CN201680009671.1, dated May 24, 2019, 19 pages.

* cited by examiner

Average increase in CD tensile strength is 25%

METHOD FOR THE SURFACE APPLICATION OF A SECURITY DEVICE OVER A PAPER MACHINE MADE HOLE

RELATED APPLICATION

This application is a continuation-in-part of U.S. patent application Ser. No. 15/041,800, filed Feb. 11, 2016, which claims priority to U.S. Provisional Patent Application Ser. No. 62/114,699, filed Feb. 11, 2015, which is incorporated herein in its entirety by reference.

TECHNICAL FIELD

In one aspect, the present invention relates to a sheet material having through-holes with one or more security devices coupled to the through-holes. Sheet materials are exemplarily used to form security documents which comprise the aforementioned through-holes and coupled security device. In another aspect, the present invention also generally relates to a method for preparing such a sheet material; a method of forming a security document; and means of securing these documents through the coupling of the through-holes with the security device(s). Through-holes described herein include "soft-edged" through-holes. Accordingly, a further aspect of the present invention also includes methods of forming soft-edged through-holes in a sheet material or, more particularly, in a security document.

BACKGROUND

Security devices, which non-exclusively include various forms of stripes, bands, threads, or ribbons, are used extensively for securing or aestheticizing high security and high value documents, providing visual and/or machine detectable means for verifying the authenticity of these documents. These security devices may be either fully embedded or partially embedded in the documents, or mounted on a surface thereof.

Security devices that are at least partially embedded can be applied to a forming fibrous web by introducing the security device into the fibrous web during a wet stage of a paper manufacturing process. However, introduction of security devices into the fibrous web in this stage, while suitable for embedded and partially embedded security devices, have heretofore been impractical for surface applied security devices since the resulting sheet material or document would be susceptible to reduced durability (e.g., circulation durability).

It has been found that during the wet stage introduction of the security device to the forming fibrous web, some of the fibers are displaced as they flow around the security device as it is pressed into the fibrous web. This results in displacement of an amount of fibers, from a sub-region (i.e., a region of the fibrous web located under or beneath the security device) and hinge areas (i.e., regions of the fibrous web located next to edges or sides of the security device) that is enough to affect the interaction of the security device with the fibrous web or with the substrate of the resulting sheet material or document. The resulting concentration of fibers in the sub-region and hinge areas is less than the concentration of fibers in at least the neighboring bulk region(s). This results in weak connective interaction at the interface of the security device and the substrate of the sheet material or document and in particular results in weak connective interaction at the interfacing surface and/or edges of the security device. During use or circulation of resulting documents, these weak regions are highly susceptible to tears in the sheet materials or documents along the interfacing edges between the security device and the substrate or produce a hinge effect (i.e., separated regions between interfacing edges). Moreover, the document tends to demonstrate backside show-through; that is, the applied security device when applied on one side of the fibrous web will produce a shadow effect that is observable from an opposing side of the fibrous web, any resulting fibrous sheet material or any resulting document. This often requires the use of a backside camouflage coating to address the problem. It has also been observed that said resulting sheet material or document demonstrates a reduction in cross-direction (CD) tensile strength.

One alternative for obtaining a surface applied security device is to apply the security device to a surface of a fully formed fibrous substrate. However, application to a fully formed fibrous substrate is accompanied by other substantial limitations. For example, this substantially limits the thickness range of the security device that can be used. Generally, surface application is limited to the very thinnest of security devices, such as less than 15 microns (μm). Thicker security devices are generally excluded from such applications at least in part because the resulting caliper differential on a resulting sheet material affects downstream processing. As used herein, the term "caliper differential" refers to the height difference measured from the upper surface of the bulk region of the sheet material to the upper surface of the security device. As such the caliper differential can be negative or positive. For example, where the upper surface of the security device rests below the height of the upper surface of the bulk region of the sheet material, the caliper differential will be negative. Conversely, where the upper surface of the security device rests above the height of the upper surface of the bulk region of the sheet material, the caliper differential will be positive. Alternatively, a zero caliper differential indicates that the upper surface of the security device is flushed with the upper surface of the bulk region. Due to the caliper differential produced with thicker security devices that are introduced either in a dry stage of the paper manufacturing process or in a post application process, downstream processes such as winding, sheeting, stacking, cutting and processing through ATMs are impacted in terms of time and costs. Significantly, stacks produced this way are not press-ready or print ready.

In view of the above, there remains a need for improved sheet materials with surface applied security devices regardless of thickness and for improved processes that can produce these sheet materials. There is also a continuing need to furnish security documents with additional authenticity features that allow the authenticity of the documents to be verified while serving to prevent unauthorized reproduction.

SUMMARY OF THE INVENTION

The present invention addresses at least one of the above needs by providing a sheet material, security document, and a method for the surface application of a security device to a fibrous sheet material or document by introducing the security device to a forming fibrous web during a wet stage of paper manufacturing. In one embodiment, the security device is applied over one or more 'soft-edged' through-holes formed in the fibrous web. The security device in this embodiment is prepared from a structural film and has a thickness of at least about 10 microns, thereby providing the device with sufficient durability to span the through-hole(s).

The term "'soft-edged' through-hole", as used herein, means a through-hole produced during paper manufacture where fibers in the sheet material extend into the opening circumferenced by the through-hole. The through-hole's opening extends from one side or surface of the web to an opposing side or surface and exhibits distinctive irregularities in the edge region. The distinctive irregularities result from the lack of a sharp cut edge and include irregular accumulations of fibers in the edge area and/or fibers which extend into the opening. Where such through openings have distinctive irregularities that often vary and are not easy to reproduce, these openings function as authenticity features having high security value. The method of the present invention comprises introducing a security device onto or into a forming fibrous web, optionally over one or more 'soft-edged' through-holes formed therein, during a wet stage of the paper manufacturing process where the fibrous web is sufficiently consolidated. In one embodiment, the fibrous web is sufficiently consolidated when the fibrous web has a water or moisture content of less than 98% by weight, based on the total weight of the fibrous web. Preferably, the fibrous web is sufficiently consolidated when the fibrous web is at or near a couch roll or similar tool of a paper machine.

The present invention also provides a fibrous sheet material produced by the above method, and a resulting document comprising the fibrous sheet material. In a first embodiment, the fibrous sheet material has opposing surfaces, at least one recess in one surface thereof, a fibrous sub-region, which is a three-dimensional volume disposed under or beneath the recess, and a fibrous bulk region, which is also a three-dimensional volume disposed next to the recess and the sub-region; a surface applied security device disposed in the recess; and an interface between the surface applied security device and the bulk- and sub-regions of the sheet material; wherein there are fibers in the fibrous sub-region and in the fibrous bulk region that are present in substantially equivalent amounts. The fibrous sub-region is coextensive in the lateral or side direction with the surface applied security device. In other words, the three-dimensional sub-region occupies the volume of the fibrous sheet material located underneath the security device. The fibrous bulk region is disposed next to the recess and the sub-region and occupies the remaining volume of the fibrous sheet material.

Confirmation that substantially equivalent amounts of fibers are present in both the sub-region and the bulk region of the sheet material is achieved by comparing the mass (weight) of the three-dimensional area of the sheet material under the security device (after the security device has been removed (see, e.g., area defined by width A, height a and depth dimension (not shown) in FIG. 11) with the mass (weight) of the three-dimensional area of the sheet material adjacent to the security device having an equivalent width (i.e., a width equal to the width of the security device) (see, e.g., area defined by width B, height b and depth dimension (not shown) in FIG. 11). In the embodiment described below in which a through-hole is present in the area of the sheet material under the security device, the mass (weight) in this area is first adjusted by adding back the mass (weight) of the area now occupied by the through-hole before comparing the mass (weight) of this area (the sub-region) to the mass (weight) of the bulk region.

In a second embodiment or aspect of the present invention, the fibrous sheet material has opposing surfaces and one or more paper machine made or 'soft-edged' through-holes. The surface applied security device is applied over the through-hole(s), the shape and size of which may be substantially the same as or different from that of the through-hole(s). For example, the surface applied security device may be shaped differently and larger than the through-hole, or it may be sized similar to and only slightly larger than the through-hole. In both cases, the fibrous sheet material and document formed therefrom would be similar to that described above except that a through-hole(s) would extend from the recess through an opposing surface of the fibrous sheet material. The fibrous sub-region having a three-dimensional volume would therefore be disposed under or beneath those areas of the recess bordering the through-hole and extend laterally therefrom to the outer perimeter of the surface applied security device. In other words, as noted above, the fibrous sub-region would occupy the space below that occupied by the surface applied security device.

Surprisingly, it has been found that the surface applied security device can be introduced during a wet stage where the fibrous web is sufficiently consolidated as, for example, a fully formed wet web. By introducing the security device at this wet stage of the paper manufacturing process, the security device can be adequately forced into the fibrous web to further consolidate the fibers in the sub-region rather than displacing them. This in turn helps in providing increased connective interaction between the fibers and the surface applied security device. As a result, at least one of durability, ink adhesion, cross-directional (CD) tensile strength, and backside show-through is improved. These surprising advantages avoid the requirement for further processing steps to improve ink adhesion, improve tensile strength or camouflage backside show-through. Moreover, because the security device is introduced during a wet stage where the fibrous web is sufficiently consolidated, it becomes possible to force the security device into the fibrous web thereby enabling the use of thicker security devices, since their caliper differential can be substantially reduced. The resulting caliper differential thereby has less effect on downstream processes.

By way of the methods provided herein, Applicant also surprisingly found that the surface applied security devices could be applied in register with at least one other feature in the fibrous web, the fibrous sheet material or a resulting document. In the second aspect of the present invention, the surface applied security device is applied in register with the through-hole(s). As will be readily appreciated by those skilled in the art, applying the security device in register with yet another feature in the fibrous web greatly increases the counterfeit-resistance of the resulting sheet material or document. Moreover, because the security device is introduced during the wet stage of the fibrous web manufacturing process, it is possible to adjust the registration during the paper manufacturing process. Accordingly, further processing steps are avoided that would otherwise be required to correct misalignment of the security device with the other features. Introducing the security device in a continuous manner also avoids the requirement for a carrier substrate, since the security device can be cut/punched and introduced to the fibrous web with a single intro-device. As used herein, the term "intro-device" refers to a device used for cutting/punching and/or introducing the security device to the fibrous web during the wet stage. Suitable intro-device is described further herein.

Those of ordinary skill in the art will be able to discern other features and advantages of the invention by following the detailed description and drawings. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting. Moreover, all ranges explicitly recited herein also implicitly cover all sub-ranges.

BRIEF DESCRIPTION OF THE DRAWINGS

The present disclosure may be better understood with reference to the following drawings. Components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary, the intent is to cover all alternatives, modifications and equivalents.

Particular features of the disclosed invention are illustrated by reference to the accompanying drawings in which.

DETAILED DESCRIPTION OF THE INVENTION

Figure 1:
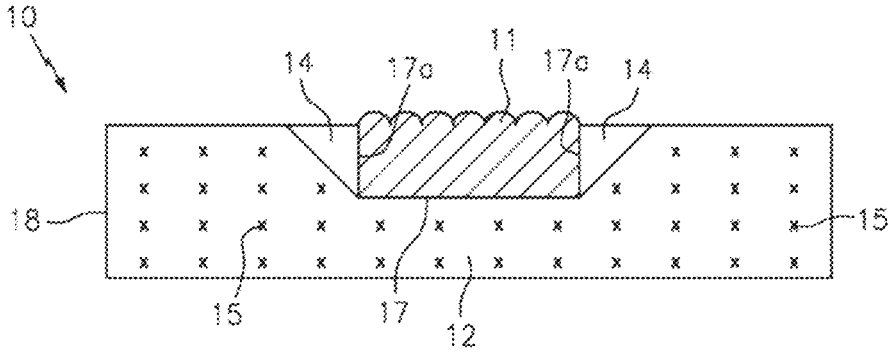
FIG. 1 (PRIOR ART)
FIG. 1 is a cross-sectional side view of a fibrous sheet material produced by introducing the security device into a fibrous web during a wet stage of paper manufacturing where the fibrous web is not sufficiently consolidated.

The invention will be further understood by the following details, which are provided as descriptions of certain exemplary embodiments of the claimed invention.

By way of the method of the present invention a fibrous sheet material comprising a surface applied security device is provided. In a first aspect of the invention, a method is provided for the surface application of a security device to a fibrous sheet material. The method comprises, introducing the security device into or onto a fibrous web during paper manufacturing. In a second aspect, the method comprises forming one or more 'soft-edged' through-holes in the fibrous web during paper manufacturing before the fibrous web becomes sufficiently consolidated and then introducing a security device into or onto the fibrous web over the one or more 'soft-edged' through-holes once the fibrous web has become sufficiently consolidated. By forming the through-holes during paper manufacture, through-holes are thereby provided with distinctive edge irregularities, which serve as authenticity features having high security value. Moreover, by introducing the security device during the paper manufacturing process, known processing steps are uninterrupted and additional processing steps are eliminated. Further, by introducing the security device during a wet stage of the paper manufacturing process, security devices thicker than those that could be applied in a dry stage of paper manufacturing, can hereby be applied.

In one embodiment, the method further comprises further consolidating the fibers in the sub-region. To further consolidate the fibers in the sub-region, the surface applied security device is pressed into the sufficiently consolidated (either uniformly or non-uniformly) fibrous web. The fibers densify in this region such that although the volume of the sub-region is reduced, the amount of fibers in this region are not displaced; at least not in any significant amounts. The fact that the fibers in this region are not displaced greatly reduces if not eliminates the possibility of the through-hole (s) becoming occluded or blocked when the fibers are further consolidated in this region.

As used herein, the term "sufficiently consolidated" will be understood, relative to the present disclosure, by those of ordinary skill in the art, to mean that the fibrous web is in a fully formed wet web state. In this wet web stage, the fibrous web comprises less than 98% water and/or moisture. Accordingly, the fibrous web comprises greater than 2% fiber and/or pulp. In another embodiment, the fibrous web comprises less than 95% water and/or moisture with the remaining 5% of constituents being fiber and/or pulp. In a more preferred embodiment, the water and/or moisture in the fibrous web ranges from about 60% to less than 98%, or from about 60% to about 95%. Applicant has found that a water and/or moisture content above 98% results in displacement of fibers when the security device is introduced. Significant displacement of the fibers, especially in a sub-region of the substrate, results in weak interactions between the security device and the fibers in the substrate. Particularly, the displacement of fibers reduces the durability and strength of the substrate and reduces the camouflaging effect provided in the sub-region and in the hinge area. As noted herein, these weak interactions, especially at the interfacing edges of the security device, results in the problems identified above. Correspondingly, it has also been found that where the fibrous web has less than 60% water and/or moisture, introduction of the security device during the paper manufacturing process does not sufficiently allow the recessing of the security device to accommodate thicker security devices while still maintaining a low caliper differential. Moreover, at below 60% water and/or moisture the fibers in the sub-region do not further consolidate enough to secure the fibers near the interfacing edges of the security device. As used herein, the term "recessing" refers to the pressing of the security device into the fibrous web to form a relief/recess in the substrate surface of the fibrous sheet material such that at least a portion of the height of the security device is recessed below the surface height of the bulk region while a top or upper surface area of the security device remains exposed.

The wet stage, as defined above, can be adjusted to be at various locations along a paper manufacturing machine and the present invention contemplates all of those possibilities. However, in a preferred embodiment the security device is applied into or onto a forming fibrous web during a wet stage of the paper manufacturing process, such as for example, at or near a couch roll or similar tool of a paper machine when the fibrous web constitutes a sufficiently consolidated, or fully formed wet web (i.e., having a moisture or water level of less than 98% by weight of the fibrous web, preferably from about 60% to less than 98% by weight of the fibrous web; or more preferably from about 60% to about 95% by weight of the fibrous web; or from about 60% to about 90% by weight of the fibrous web, based on the total weight of the fibrous web). At such locations there is no need for further process adjustments to accommodate the integration of the security device into the recess. For example, suction boxes are typically located right before the couch roll to remove as much moisture as possible before the web leaves the wet end of the machine so as to minimize the burden on the machine's dryer section. Similarly, upon leaving the cylinder part of the cylinder paper machine (and after the couch roll), the fibrous web will preferably be made up of from about 75% to about 95% water and/or moisture and from about 5% to about 25% pulp or fiber.

While several stages of paper manufacture on a Fourdrinier paper machine are contemplated as providing sufficient consolidation (as defined herein) of the fibrous web, in a preferred embodiment the stage of paper manufacture where the security device is introduced to the fibrous web is directly after the wet line and before the couch roll. This is the point at which there is no more surface water apparent on an upper side of the fibrous web. In an alternative embodiment, the security device is introduced to the fibrous web on or before a vacuum box in the wet end, which advantageously helps set the device into the web. Preferably, the security device is placed directly to the face of the fibrous web via a delivery wheel, a roller or a contacting shoe.

In one embodiment, upon moving past or further beyond the couch roll the fibrous web is in a state of being a fully formed web with surface applied security device as it proceeds to the dry end of the paper machine, which consists of both the press section and the dryer section.

In the press section of both types of paper machines, water and/or moisture is removed by compressing the wet paper between rollers and felts to reduce the water and/or moisture content to a desired level. Applicant has surprisingly found that compression of the fully formed wet web with surface applied security device causes fibers in the sub-region (i.e., the area of the fibrous web that is below or beneath the introduced security device) to be further consolidated as they are densified instead of displaced. As a result, the strength characteristics of the resulting fibrous sheet material or resulting document as well as backside opaqueness, which provides camouflaging of the security device to reduce backside show-through, are improved.

Security devices of the present invention may be of various thicknesses. However, it has been found that the present inventive process advantageously allows the surface application of security devices that are on the thicker end of the thickness spectrum. In one embodiment, the security devices are of thicknesses of up to 100 microns (μm). In another embodiment, the security device has a thickness ranging from 5 to 75 μm or more preferably, from 10 to 50 μm. The width of the security device is limited only by the width of the fibrous sheet material. In a preferred embodiment, the width ranges from 0.25 to 20 millimeters (mm); more preferably from 0.5 to 15 mm.

By introducing the security device during a wet stage of paper manufacturing, these security devices can be pressed into the fibrous web to produce a recess in the surface of the resulting fibrous sheet material. The resulting fibrous sheet material comprises a surface applied security device, which has a caliper differential that does not result in the disadvantages identified above. In one embodiment, the caliper differential is expressed relative to the thickness of the security device. In this embodiment, the absolute value of the caliper differential ranges from 0% to about 80% of the thickness of the security device; preferably less than 10% of the thickness of the security device.

In one embodiment, the caliper differential ranges from −10 to about 50 μm. More preferably, the caliper differential ranges from −5 to 30 μm; or from 0 to 25 μm.

In certain embodiments, the device is sufficiently thin such that pressing of the security device into the fibrous wet web results is a negative caliper differential (i.e., the thickness or height of the security device is less than the thickness or height of the bulk region). In such embodiments, caliper differential is best characterized by a reference to the absolute value of the caliper differential relative to the thickness of the security device. For example, in one embodiment the thickness of the security device is less than 25 μm such that when the security device is pressed into the fibrous web the absolute value of the caliper differential of the surface applied security device ranges from 0% to about 50%; more preferably from 0% to about 30%; even more preferably from about 0% to about 10% of the thickness of the security device. In one other embodiment, the thickness of the security device is again less than 25 μm such that further consolidation of the sub-region by pressing the security device into the fibrous web, produces a caliper differential ranging from −10 to 15 μm; preferably −5 to 10 μm.

Alternatively, in one embodiment the thickness of the security device is greater than 25 μm such that further consolidation of the sub-region by pressing the security device into the fibrous web produces a caliper differential ranging from −10 to 50 μm; preferably from −5 to 25 μm or from 0 to 15 μm. In one other embodiment where the security device also has a thickness of greater than 25 μm, the absolute value of the caliper differential relative to the thickness of the security device ranges from 0% to about 50%. Preferably, the absolute value of the caliper differential ranges from 0% to about 20% of the thickness of the security device.

A "couch roll" will be understood by those of ordinary skill in the art as a guide or turning roll for a Fourdrinier wire on a Fourdrinier paper machine, positioned where the paper web leaves the wire (i.e., the wet end or paper forming section) and the wire returns to the breast roll. The couch roll serves the same purpose on a cylinder paper machine where the Fourdrinier wire part has been replaced by a cylinder part. Specifically, as the web leaves the cylinder part and travels toward the couch roll, the couch roll guides and turns the web.

Although it is also contemplated that the entire fibrous web has a uniform consistency with regard to the water and/or moisture content and fiber content, it is also within the scope of the present invention that the fibrous web is non-uniformly sufficiently consolidated. For example, in one embodiment, the fibrous web is only sufficiently consolidated at or along a point of introduction. As used herein, the "point of introduction" refers to the region at or along the fibrous web that is at least partially covered by the security device. In another embodiment, the fibrous web is only partially sufficiently consolidated or is sufficiently consolidated in a gradient or matrix pattern, such that at the point of introduction, the fibers are not significantly dispersed to lead to the identified disadvantages. A sufficiently consolidated gradient or matrix pattern can be provided, for example, by selective vacuuming at locations along the forming fibrous web. Alternatively, in one embodiment, the moisture content is removed in a gradient or matrix pattern by applying a radiation source (i.e., heat) to remove top-surface water at selected locations along the forming fibrous web.

Introduction of the security device to the fibrous web forms an interface between the security device and the substrate fibrous web, the resulting fibrous sheet material or the resulting document. The term "interface" as used herein can be formed by either direct or indirect contact between the security device and the substrate. Where the interface is direct, the security device is in direct contact with the fibers in the substrate. However, it is contemplated that the security device forms an indirect interface along some or all bottom and side surfaces with the substrate. For example, the interface may comprise other materials between the security device and the substrate. While various materials are contemplated, further fibrous or polymeric materials, for example, monocomponent and/or multicomponent fibers obtained from natural sources such as vegetative sources, or spun from polymer melt compositions, etc., alone or in combination, are particularly suitable. Moreover adhesive materials are preferred for forming the indirect interface. Activatable adhesives may be used to anchor or bond the security device onto or within the fibrous web's recessed surface. Suitable adhesives are not limited and include, but are not limited to, water-, heat- and/or pressure-activating adhesives that activate in a dryer section of the paper machine, where temperatures reach between 100° C. and 160° C. These coatings may be applied in the form of solvent-based polymer solutions or aqueous solutions or dispersions. Suitable dispersions are selected from the group of acrylic resin dispersions, epoxy resin dispersions, natural latex dispersions, polyurethane resin dispersions, polyvinyl acetate resin dispersions, polyvinyl alcohol resin dispersions, urea formaldehyde resin dispersions, vinyl acetate resin dispersions, ethylene vinyl acetate resin dispersions, ethylene vinyl alcohol resin dispersions, polyester resin dispersions, and mixtures thereof. Upon moving past the couch roll, the fully formed wet web with surface applied security device proceeds to the dry end of the paper machine, which consists of both the press section and the dryer section. The adhesive may alternatively form part of the security device and in such embodiments have a thickness ranging from 5 to about 50 μm; preferably from 5 to about 20 μm.

Security devices suitable for the present invention include those generally used in the art by those of ordinary skill to provide security against forgery or counterfeiting. In the second aspect of the present invention, the security device is preferably formed from a structural film (e.g., a polyethylene terephthalate (PET) film) and has a caliper or thickness of at least about 10-15 microns, which provides the device with sufficient durability to allow it to span the through-hole(s). The term "structural film" as used herein is intended to mean a film with structural integrity which is an integral part of the construction of the security device and not, for example, a removable carrier film as is usually used with transfer foils, or the transfer foil itself. The security devices may be those suitable for alternatively or additionally applying aesthetic characteristics to a substrate. Suitable security devices may display information that is humanly perceivable either directly or with the aid of a device or may display information that is additionally or alternatively perceivable by a machine. The security device may employ one or more of the following features: demetalized or selectively metalized, magnetic, combined magnetic and metallic, or embossed regions or layers, color changing coatings made up of color shift, iridescent, liquid crystal, photochromic and/or thermochromic materials, coatings of luminescent and/or magnetic materials, holographic and/or diffractive security features, and micro-optic security features. In a preferred embodiment, the security device provides security such that a security or value document can be readily authenticated. In one embodiment the security device comprises an array of focusing elements and an array of image icons where the array of focusing elements and image icons are arranged such that one or more synthetic images are projected by the security device. Focusing elements used in the present invention serve to highlight, magnify, illuminate, or accentuate a small point in the image icon array and include, but are not limited to, both lenticular lenses and non-cylindrical lenses (i.e., micro-lenses). Synthetic imaging, which is alluded to above, is a form of integral imaging because the image that is perceived by a viewer is synthesized from hundreds or thousands of individual image fragments magnified by lenses (e.g., microlenses) and projected toward a viewer's eyes.

In an exemplary embodiment, the security device is a micro-lens based security device. Such devices generally comprise (a) a light-transmitting polymeric substrate, (b) an arrangement of micro-sized image icons located on or within the polymeric substrate, and (c) an arrangement of focusing elements (e.g., microlenses). The image icon and focusing element arrangements are configured such that when the arrangement of image icons is viewed through the arrangement of focusing elements, one or more synthetic images are projected. These projected images may show a number of different optical effects. Material constructions capable of presenting such effects are described in U.S. Pat. No. 7,333,268 to Steenblik et al., U.S. Pat. No. 7,468,842 to Steenblik et al., U.S. Pat. No. 7,738,175 to Steenblik et al., U.S. Pat. No. 7,830,627 to Commander et al., U.S. Pat. No. 8,149,511 to Kaule et al.; U.S. Pat. No. 8,878,844 to Kaule et al.; U.S. Pat. No. 8,786,521 to Kaule et al.; European Patent No. 2162294 to Kaule et al.; and European Patent Application No. 08759342.2 (or European Publication No. 2164713) to Kaule. These references are hereby incorporated in their entirety.

In a preferred embodiment, the security device that is being surface applied by the present inventive method includes, but is not limited to, micro-optic security devices such as the MOTION™ micro-optic security device, which is described in, for example, U.S. Pat. No. 7,333,268, the RAPID™ micro-optic security device, holographic security devices (e.g., metalized holographic devices). These devices are available from Crane Currency US, LLC of Massachusetts, USA. Other suitable devices include, but are not limited to optically variable devices (OVDs) such as the KINEGRAM™ optical data carrier, and color-shift security devices.

While the security device may be presented in various forms to be introduced to the fibrous web, it has been found most advantageous to provide the security device in the form of a continuous web. By providing the security device in the form of a continuous web, it has been found that the security device can be introduced to the fibrous web in a continuous manner. The continuous web is then sectioned or divided up into a plurality of discontinuous security devices. The sectioning of the continuous web into discontinuous security devices can be accomplished by various cutting and/or punching methods. In a preferred embodiment, the method is an in-line application process of the plurality of discontinuous security devices, without the use of a carrier film, to the fibrous web during manufacture on a paper machine. This method comprises providing the security device in the form of a continuous web; cutting or punching the continuous web in a continuous manner to form the discontinuous security devices, each having a desired shape and size; and then applying the discontinuous security devices in a continuous manner onto the fibrous web during paper manufacturing.

It is contemplated herein that additional security devices may be applied to the fibrous sheet material; either by surface application, partial embedment or total embedment. For example, in one embodiment, an additional security device is applied to the surface of the fibrous sheet material. Said additional device may be introduced to the fibrous web before the surface applied security device is introduced or applied after the surface applied security device is introduced. The additional security device may be different from or similar to the surface applied security device. For example, in one embodiment when one of the discontinuous security devices has a thickness of 25 μm or less, it is contemplated that it is introduced to the fibrous web when the moisture content is less than 60%; preferably ranges from about 90% to 0% by weight. For example, the security device is introduced to the fibrous web as it travels through the paper machine between the first dryer section and the size press and optionally rewetted to increase the water and/or moisture content to between about 4% and about 7%.

The security devices may take various sizes, shapes, or colors. For instance, it is contemplated that the security device, in the form of the discontinuous security device, takes the non-limiting form of a stripe, a band, a thread, a ribbon or a patch. These devices may be from about 2 to about 25 mm (preferably, from about 6 to about 12 mm) in total width, and from about 10 to about 50 microns (preferably, from about 20 to about 40 microns) in total thickness. In a preferred embodiment, the security device is a stripe or patch. A "stripe," as used herein, refers to a security device having a longitudinal length dimension that is substantially longer than its latitudinal width dimension. A "patch," by contrast, may have substantially equivalent longitudinal and latitudinal lengths and may have uniform or various non-uniform shapes. Various shapes and sizes of stripes and patches are contemplated herein. However, while a stripe or patch may extend to the edge of a fibrous sheet material or a resulting document, in a preferred embodiment, the stripe or patch is located within the perimeter of the fibrous sheet material or document and does not extend to the edge of the sheet material or document.

As noted, various sizes of security devices are contemplated as suitable for the inventive method and fibrous sheet material. In one embodiment, the size ranges from about 5 to about 75 mm, preferably from about 15 mm to about 40 mm in total length and; from about 2 mm to about 50 mm, preferably from about 6 mm to about 25 mm in total width; and from about 10 to about 50 microns, preferably from about 15 microns to about 40 microns in total thickness. All ranges noted herein include all subranges, including integers and fractions. As noted above, in the second aspect of the present invention, the security device is preferably formed from a structural film (e.g., a polyethylene terephthalate (PET) film) and has a caliper or thickness of at least about 10-15 microns, which provides the device with sufficient durability to allow it to span the through-hole(s).

As noted, various shapes are also contemplated for the security devices; for example, patches, stripes, or threads, geometric shapes such as stars, parallelograms, polygonal (e.g., hexagons, octagons, etc.) shapes, numbers, letters and various symbols. Simple and complex non-geometric designs are also contemplated as suitable. These shapes and designs can be cut with a rotary die process.

In one embodiment of the inventive method, the security device is introduced into the forming fibrous web such that it is in register with at least one other feature on or in the substrate of the fibrous web, the fibrous sheet material or the resulting document. In certain embodiments, the security device is introduced such that a particular feature within the security device is in register with another feature in the fibrous web, the resulting fibrous sheet material or document. The at least one other feature can be varied as necessary relative to the application. For example, the at least one other feature is a watermark, a printed image, a relief structure, another security device, or a paper-borne feature. In the second aspect of the present invention, the security device is introduced such that it is preferably in register with one or more 'soft-edged' through-holes. In introducing the security device to the fibrous web such that it is in register, it is contemplated that the security device, first presented in the form of a continuous web, is delivered to a piece of equipment or system (referred to herein as the intro-device) that can be used to cut/punch the continuous web into discontinuous security devices. While it is possible to use a separate device to cut then apply the security device to the fibrous web, it is preferred that the system used for forming the discontinuous security devices is also used for applying the security devices into or onto the fibrous web. With a single device, it is possible to more precisely apply the security device in register since it requires less moving parts.

In the preferred embodiment wherein the continuous web is cut into discontinuous security devices that are then introduced into or onto the fibrous web by the same intro-device, it is also contemplated that the placement of the security device is adjustable by the intro-device such that a mis-registered (misaligned with the at least one other feature) security device can be adjusted in a continuous manner to be in register. By using a single intro-device to cut, apply and adjust registration in situ with the paper manufacturing process, additional processing to adjust the placement is rendered unnecessary. For example, the registered application and adjustment during the paper manufacturing process eliminates the need for secondary processing of the resulting sheet material or document prior to printing.

Suitable intro-devices will be apparent to those of ordinary skill in hindsight of the instant disclosure. However, in a preferred embodiment, the intro-device is a system that employs either an optical or a fiber-density sensor that checks the registration between the security device and the at least one other feature in the fibrous web, the fibrous material or the resulting document. In view of the identified or calculated location of the security device or the relative locations of the security device and the at least one other feature, the intro-device is used to make adjustments in the placement of the security device. To make such adjustments the intro-device uses a variable speed advancing device (e.g., electric servomechanism with servo drive) that controls the tension on the continuous web such that the discontinuous security device can be applied in register as desired. The point of introduction of the security device is thereby continuously adjusted by modulating a tension on the continuous web. Alternatively, the intro-device may be a rotary die cut and transfer device such as that used in the label industry to apply labels in registration.

In the second aspect of the invention, a method is provided for the formation of one or more 'soft-edged' through-holes in a forming fibrous web and then the surface application of a security device over the through-hole(s). In this second aspect, the method comprises: forming one or more 'soft-edged' through-holes in a forming fibrous web during paper manufacturing and once the fibrous web is sufficiently consolidated (uniformly or non-uniformly), introducing a security device into or onto the forming fibrous web over the one or more 'soft-edged' through-holes.

While the second aspect of the present invention is described as having the security device located over the through-hole(s), the security device and through-hole(s) may be registered in other ways or not at all. For example, the security device and through-hole(s) may be registered in a side-by-side configuration with the security device located next to the through-hole(s) on/in the fibrous web.

In one embodiment of the inventive method, the method further comprises further consolidating fibers in a sub-region of the fibrous sheet material. To further consolidate the fibers in the sub-region, the surface applied security device is pressed into the sufficiently consolidated fibrous web. The fibers densify in this region such that although the volume of the sub-region is reduced, the amount of fibers in this region (surrounding the through-hole(s)) are not displaced; at least not in any significant amounts. As noted above, the fact that the fibers in this region are not displaced greatly reduces, if not eliminates, the possibility of the through-hole(s) becoming occluded or blocked with the fibers are further consolidated in this region.

The through-hole(s) is produced during the wet web stage of paper manufacture before the forming fibrous web becomes "sufficiently consolidated". In other words, the fibrous web is not in a fully formed wet web state. Accordingly, the fibrous web comprises a water and/or moisture content above 98% by weight of the fibrous web. To enable the production of this through opening, the screen of the paper machine must be provided with at least one water-impermeable element, which prevents sheet formation in this area. The papermaking screen may be a continuously moving forming wire of a Fourdrinier paper machine or a cylinder of a cylinder mold paper machine.

The through-hole can adopt any suitable size and shape or outline contour. For example, the through-hole may be circular, oval, star-shaped, formed like a parallelogram (e.g., square, rectangle) or a trapezium, etc. In an exemplary embodiment, the hole has at least one crossing dimension that is approximately 1 millimeter (mm) narrower/smaller than the security device placed over it. Crossing dimension refers to the line between two points on the hole that crosses at least a portion of the security device. So, if the hole is 5 mm in diameter, the device would have to have a minimum dimension of at least about 6 mm. If the hole is irregular (e.g., star-shaped), the narrowest edge of the device would have to be about 1 mm away from the widest edge of the hole. The shape or outline contour of the through-hole(s) may match or coordinate with the shape or outline contour of the security device and/or an image displayed or projected by the security device.

After the through-hole(s) is formed and the fibrous web sufficiently consolidated, a security device is applied over the through-hole(s). As noted above, in a preferred embodiment, the security device is applied into or onto the forming fibrous web during a wet stage of the paper manufacturing process, such as for example, at or near a couch roll or similar tool of a paper machine when the fibrous web constitutes a sufficiently consolidated, or fully formed wet web (i.e., having a moisture or water level of less than 98% by weight of the fibrous web, preferably from about 60% to less than 98% by weight of the fibrous web; or more preferably from about 60% to about 95% by weight of the fibrous web; or from about 60% to about 90% by weight of the fibrous web, based on the total weight of the fibrous web).

The surface applied security device may be shaped the same or different than the through-hole(s) and may be sized much larger or only slightly larger than the through-hole(s). As noted above, the security device may take the non-limiting form of a stripe, a band, a thread, a ribbon or a patch, while the through-hole may be circular, oval, star-shaped, formed like a parallelogram (e.g., square, rectangle) or a trapezium, or the like. In one exemplary embodiment, the surface applied security device is an elongate security thread having a width ranging from about 5 to about 20 mm (preferably from about 8 to about 12 mm) that extends along all or part of the entire length or width of a fibrous sheet material made from the fibrous web. In another exemplary embodiment, the through-hole has a circular shape with a maximum diameter ranging between 5 and 15 mm (preferably from about 7 to about 10 mm), and the surface applied security device is a patch having a complementary or contrasting shape and having a width and length at least 2 mm larger than the hole.

In another aspect of the invention, a fibrous sheet material is provided. The fibrous sheet material as described herein results from further processing of the fibrous web after the security device has been introduced thereto. Said further processing optionally includes a drying step that is applied before or after pressing the security device into the fibrous web. The pressing of the security device into the fibrous web produces a fibrous sheet material having a fibrous bulk region and a fibrous sub-region.

In a first aspect, the resulting fibrous sheet material, which has opposing surfaces and a recess in one opposing surface, comprises: a surface applied security device disposed in the recess; a fibrous sub-region disposed beneath the recess; a fibrous bulk region disposed next to the security device (disposed in the recess) and the sub-region; and an interface between the security device and at least one surface of the fibrous sheet material. In a second aspect, the resulting fibrous sheet material has one or more 'soft-edged' through-holes which extend from the recess to an opposing surface of the fibrous sheet material. As used herein, reference to a bulk region being next to the security device indicates that in a cross-sectional view the bulk region is the three-dimensional region adjacent to the security device along the x-axis. As used herein, reference to a sub-region being beneath the security device indicates that in a cross-sectional view the sub-region is the three-dimensional region along the y-axis that at least part of the security device covers. The sub-region has a thickness that is less than the thickness of the bulk region such that the surface applied security device has a caliper differential that is less than 80% of the thickness of the security device or as described above in the specified ranges and implied subranges.

In one embodiment, fibers in the sub-region are further consolidated such that the amount of fibers in the sub-region is substantially equivalent to fibers in at least the immediate adjoining bulk region. In one other embodiment, the amount of fibers in the sub-region is substantially equivalent to the amount of fibers in the bulk region. As used herein, the term "substantially equivalent", as reference to the amount of fibers in the bulk- and sub-regions, means that the amount of fibers in each region are within 80% to 100% of the amount in the other; preferably 90% to 100% as characterized by the grams per square meter (gsm) of fibers. In a preferred embodiment, the amount of fibers in the sub-region is equivalent to an amount ranging from 80% to about 100% of the bulk region; particularly the immediate adjoining bulk region.

As noted herein, various thicknesses may be attributed to a suitable security device. Consequently, various caliper differentials are also contemplated. In one embodiment of the fibrous sheet material, the security device has a thickness ranging from about 10 to about 75 microns. The caliper differential range from about −10 to about 30 microns; preferably from 0 to about 25 microns; preferably from about 0 to about 15 um.

In one embodiment of both the first and second aspect of the present invention, the fibrous sheet material demonstrates at least one of (1) improved durability, (2) acceptable ink adhesion, (3) high cross-direction (CD) tensile strength, or (4) reduced backside show-through. As used herein, improved durability is characterized by at least one of (a) minimal or reduced damage at the interface when compared to such sheet materials that are produced when the fibrous web is not sufficiently consolidated or (b) almost no hinge effect. These effects can be quantified or qualified by known industry techniques that simulate the effects of circulation of the documents. For example, the circulation of a banknote can be simulated with a durability test. One such suitable durability test is the "Circulation Simulation" Test (CST). This is a wear and tear test designed to approximate the mechanical and optical degradation experienced by a banknote through its circulation lifecycle. This test is performed by attaching rubber grommets, each weighing 7.5 grams, to the four corners of a banknote, and then placing the weighted banknote in a rock tumbler at a speed calibrated to 60 revolutions per minute (RPM) for a fixed duration of 30 minutes (one (1) cycle). The tumbling action experienced by the weighted banknote induces mechanical and optical degradation. Controlled amounts of liquid and solid soiling agents (e.g., soybean oil and clay) are then added to the rock tumbler to simulate the influence of oils and dirt which a banknote would typically come in contact with during its lifecycle. The banknote is tested before and after each round of simulated degradation for mechanical deterioration (e.g., surface and edge damage in the form of holes, tears, cuts, hinges, separated parts and ragged uneven edges, loss of tensile strength, fold endurance, tear resistance, and perforation resistance), optical deterioration (e.g., deterioration in printing ink color properties) and soiling.

Hinge effects and tearing at the interface are examples of mechanical degradation that are particularly suited for this durability test.

Figure 14:
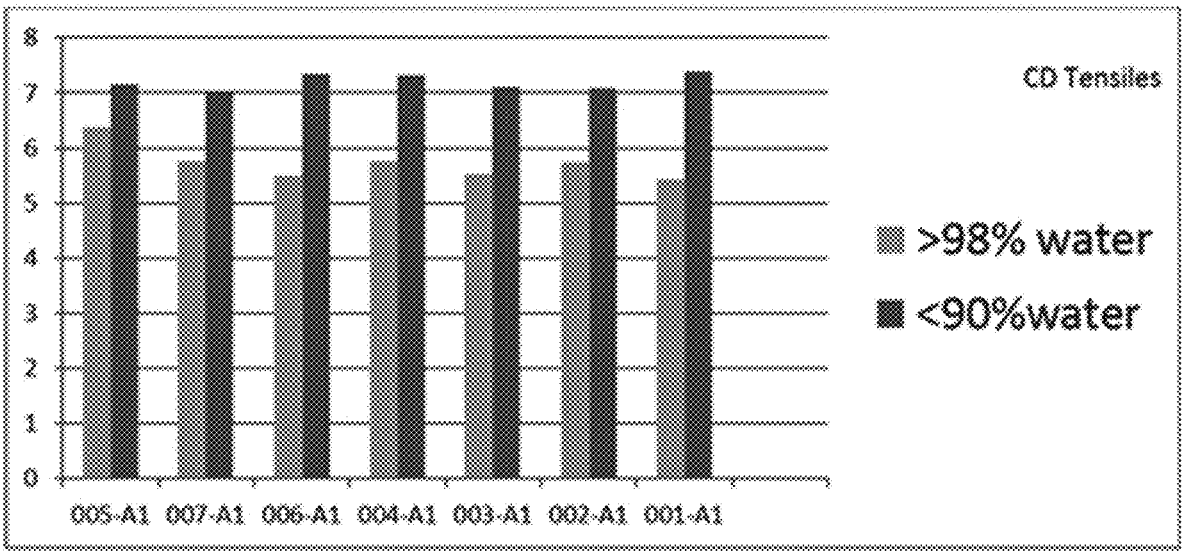
FIG. 14 illustrates a comparison of measured tensile strength between a comparison group and at least one embodiment according to the present disclosure.

Tests for acceptable ink adhesions are known to those of ordinary skill in the art. For example, ink set-off, which is the amount of ink that is transferred from one sheet to another in a stacked formation of multiple fibrous sheet materials or documents, can be quantitatively measured by methods known to those of ordinary skill in the art. Similarly, tensile strength and backside show-through can be quantified by methods known to those of ordinary skill in the art. For instance, show-through can be quantified by known light reflectance or transmittance tests. In CD tensile strength tests using, for example, an INSTRON® tension tester, or pull tester, and as shown in FIG. 14 of this disclosure, papers made in accordance with the present invention demonstrated an increase in CD tensile strength, with the tested property having an increased value ranging from about 90% to about 100%, when compared to conventional cylinder application of the security device to a fully formed fibrous web.

The fibrous sheet material, as noted, has a fibrous sub-region beneath the security device and a fibrous bulk region next to the security device and sub-region. Because the security device was introduced when the fibrous web was sufficiently consolidated, the fibers in the region of the fibrous web which corresponds to the sub-region in the sheet material were not displaced in an amount that results in the identified disadvantages. As such, the amount of fibers in the fibrous sub-region is substantially equivalent to the amount of fibers in at least the immediate adjoining bulk region. As used herein, the term "immediate adjoining bulk region" refers to a three-dimensional region in the bulk region that abuts the sub-region and the recessed portion of the security device. This immediate adjoining bulk region extends radially from the recessed portion and the sub-region to a distance in the cross-sectional x-axis that is equivalent to the x-axis length of the sub-region. In view of the volume difference between the immediate adjoining bulk region and the sub-region, the density of fibers in the sub-region is greater than the density of fibers in the immediate adjoining bulk region. The amount of fibers in the immediate bulk region and sub-region are substantially equivalent such that given the difference in volume of the two regions, the density in the sub-region is greater than the density in the immediate adjoining bulk region. In one exemplary embodiment, the amount of fibers in the bulk region ranges from 88.55 gsm to 90.15 gsm, while the amount of fibers in the sub-region ranges from 87.26 gsm to 90.69 gsm. As used herein, "density" refers to the average amount of fibers in a volume.

In the second aspect of this invention, the fibrous sheet material, which has opposing surfaces, one or more 'soft-edged' through-holes, and a recess over the one or more through-holes, comprises: a surface applied security device disposed in the recess; a fibrous sub-region disposed beneath the recess, which delineates the through-hole(s); a fibrous bulk region disposed next to the security device (disposed in the recess) and the sub-region; and an interface between the security device and the fibrous sub-region and bulk region of the fibrous sheet material. The fibrous sub-region extends along the area defined by the outer perimeter of the through-hole(s) and the outer boundary(ies) of the security device.

As noted herein, security devices suitable for the present invention are numerous. However, in one embodiment, the fibrous sheet material comprises a security device having an array of cylindrical and/or non-cylindrical focusing elements, and an array of image icons that optically interact with the focusing elements to produce at least one synthetic image. In preferred embodiments the focusing elements are exclusively either cylindrical lenses or non-cylindrical lenses (e.g., micro-lenses). However, it is contemplated herein that the array of lenses comprises a blend of both in various ratios.

As noted herein, the security device can be in the form of stripe or patch or other shapes or geometries. In one embodiment the security device is present in the sheet material in register with at least one other feature in the sheet material. Suitable other features are described herein.

In another aspect, the invention is a document comprising the fibrous sheet material. Various documents are contemplated by the present invention. For example, suitable documents include, but are not limited to, banknotes, bonds, checks, traveler's checks, identification cards, lottery tickets, passports, postage stamps, stock certificates, as well as non-security documents such as stationery items and labels and items used for aesthetics. A plurality of security devices may be introduced into the fibrous web and consequently a plurality of security devices can be found applied to the fibrous sheet material and any resulting document. Alternatively, in one embodiment, the document comprises at least one surface applied security device and at least one other security device such as an embedded or partially embedded security device or security feature. The surface applied security device can be in register with other features of the document such as other security devices or security or decorative features.

Fibrous sheet materials suitable for use in the present invention are paper or paper-like sheet materials. These sheet materials, which are single or multi-ply sheet materials, may be made from a range of fiber types including synthetic or natural fibers or a mixture of both. For example, these sheet materials may be made from fibers such as abaca, cotton, linen, wood pulp, and blends thereof. As is well known to those skilled in the art, cotton and cotton/linen or cotton/synthetic fiber blends are preferred for banknotes, while wood pulp is commonly used in non-banknote security documents.

As noted above, security devices contemplated for use with the present invention may take a number of different forms including, but not limited to, stripes, bands, threads, ribbons, or patches (e.g., micro-lens based, holographic and/or color shift security threads).

Further understanding of the claimed invention will be aided by the following description of figures that represent exemplary embodiments.

Figure 2:
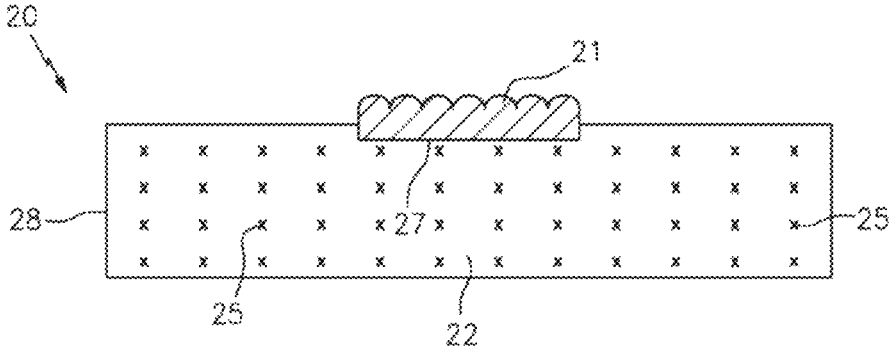
FIG. 2 (PRIOR ART)
FIG. 2 is a cross-sectional side view of a fibrous sheet material produced by introducing the security device onto a fibrous web during or after a dry stage of paper manufacturing when the moisture content is too low to allow pressing of the security device into the substrate to further consolidate the fibers.

Conventional techniques are depicted in FIG. 1 and FIG. 2. Generally, as shown in FIG. 1, the security device (11) is introduced in the wet stage of paper manufacturing to embed device (11) in a fibrous sheet material or document (10). When this method is used to surface apply the security device, the resulting fibrous sheet material suffers from low circulation durability, poor CD tensile strength and high backside show-through. As mentioned elsewhere herein, this has been discovered to be due in part to the displacement of fibers (15) from sub-region (12) when the security device (11) is introduced to the forming fibrous web. As can be seen, the amount of fibers in hinge area (14) is significantly reduced. This results in weak interactions at interface (17) between the security device and the substrate (18) of the fibrous sheet material or document (10). This is especially evident at interfacial edges (17*a*).

Disadvantages are also found in the conventional embodiment shown in FIG. 2, where security device (21) is introduced in a dry stage of paper manufacturing or after paper manufacturing when the paper is fully consolidated. Here, fibers (25) in sub-region (22) are so fully consolidated such that the security device (21) cannot be pressed into the substrate (28). As a result, the caliper differential is high. High caliper differential has been associated with poor ink application to the sheet material or document (20). As a consequence, for embodiments where the security device is added in a dry stage, the security device must be very thin in order to have a suitable caliper differential.

Figure 3:
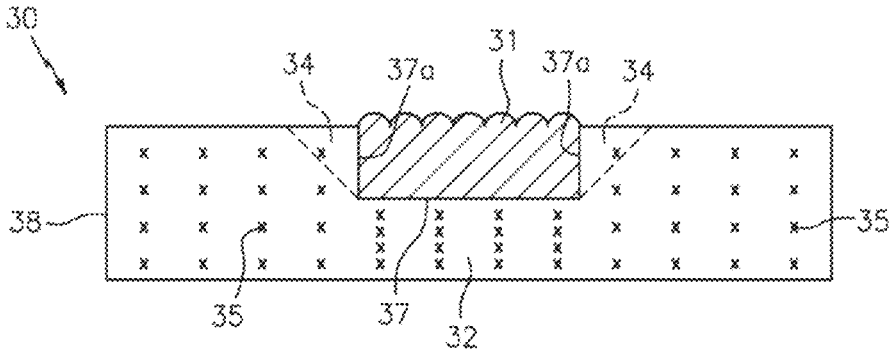
FIG. 3 is a cross-sectional side view of an exemplary embodiment of the fibrous sheet material of the present invention with its surface applied security device, where the security device is introduced into or onto the fibrous web when the fibrous web was sufficiently consolidated.

At least one of these disadvantages is addressed by the present invention. FIG. 3 depicts one embodiment of the present invention. Here, unlike in FIG. 1 and FIG. 2, the security device (31) is introduced in a wet stage when the fibrous web is sufficiently consolidated such that a substantial amount of fibers (35) are not displaced from the sub-region (32) when the security device is pressed into the substrate (38) of the fibrous sheet material (30). Rather, the fibers (35) are further consolidated or densified under the security device (31) and in the hinge area (34). This results in strong fiber interactions at the interface (37) and particularly at the interfacial edges (37*a*). Moreover, since the security device (31) is introduced during the wet stage, it can be pressed into the substrate (38) to provide a low caliper differential.

Figure 4:
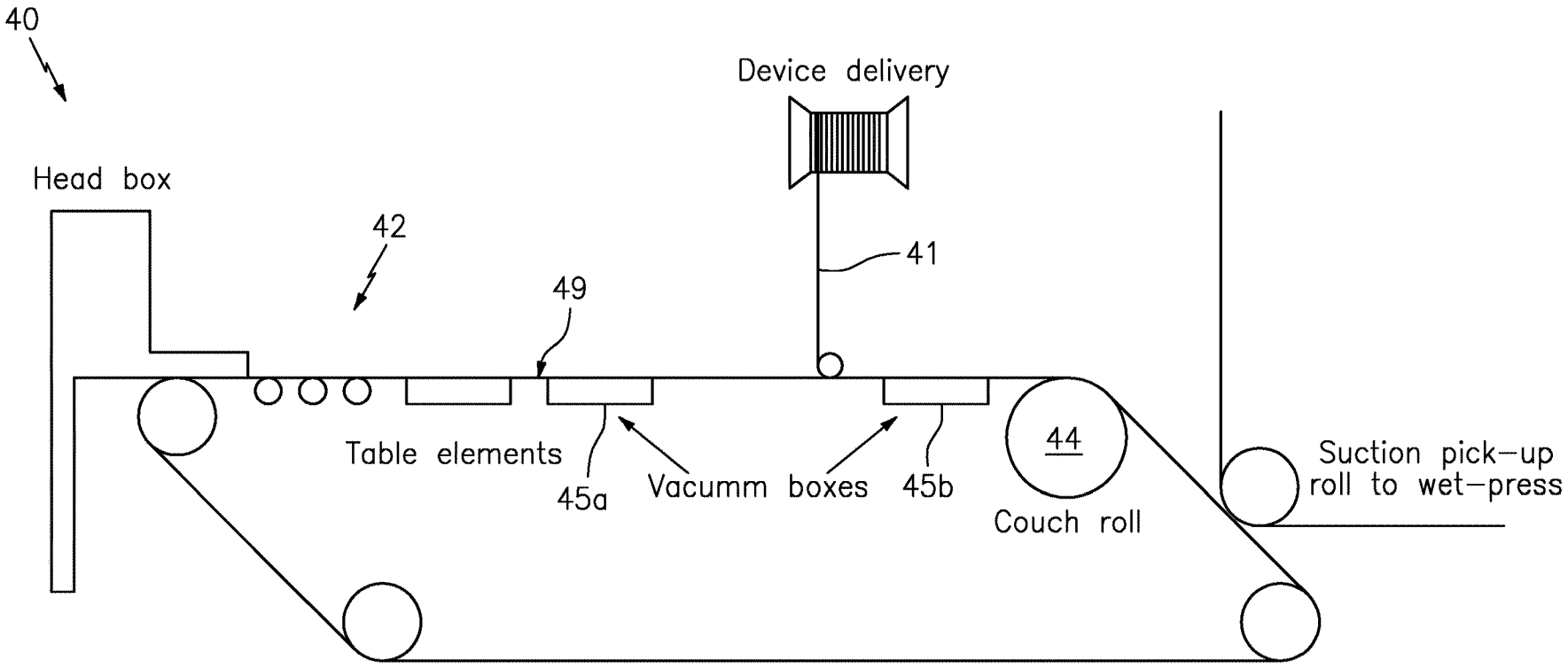
FIG. 4 is a schematic diagram of a Fourdrinier paper machine where the security device, in the form of a continuous web, is introduced to a forming fibrous web on a wire after the wet line and before the couch roll.

The security device (41) may be introduced to the fibrous web (49) using various methods and techniques. In a preferred embodiment, which is shown in FIG. 4, the security device (41) is presented in the form of a continuous web and is continuously applied to the forming fibrous web (49) on a Fourdrinier paper machine (40) directly after the wet line (42) and before couch roll (44), and between vacuum boxes (45*a*, 45*b*), which help set the security device into the fibrous web (49).

Figure 6:
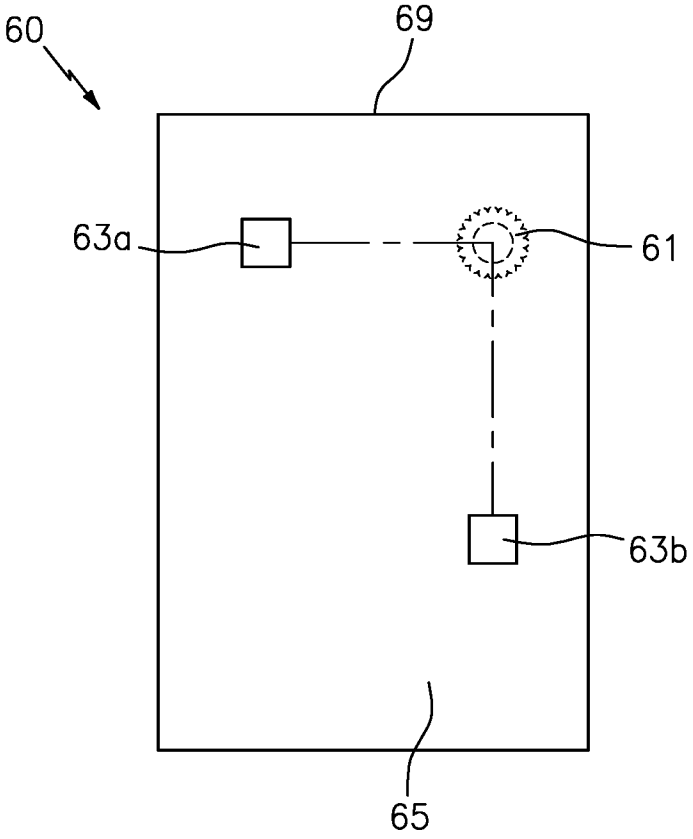
FIG. 6 is a top plan view of another exemplary embodiment of a document in accordance with the present invention which has a plurality of discontinuous surface applied security devices (patches) that are applied in register with another feature in the document, such as a watermark.
Figure 5:
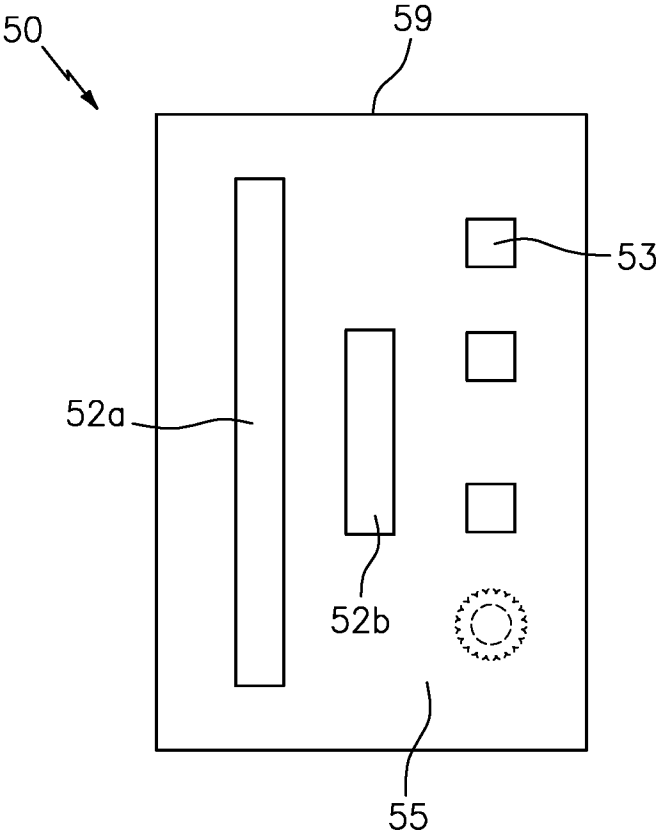
FIG. 5 is a top plan view of an exemplary embodiment of a document in accordance with the present invention which has a plurality of discontinuous surface applied security devices (patches and stripes) applied thereto.

FIGS. 5 and 6 depict fibrous sheet materials or resulting documents (50, 60) of the subject invention having a plurality of surface applied security devices (52*a*, 52*b*, 53, 63*a*, 63*b*). The devices (52*a*, 52*b*, 53, 63*a*, 63*b*) are presented here in the form of patches (53, 63*a*, 63*b*) and stripes (52*a*, 52*b*) of different sizes and shapes. While not so limited in terms of location of placement of the security device (52*a*, 52*b*, 53, 63*a*, 63*b*), in one embodiment of the present invention, the security devices (e.g., 53, 63*a*, 63*b*) are cut or punched and applied by an intro-device (not shown) to the fibrous web (55) during paper manufacturing such that it is in register with at least one other feature (e.g., watermark (61)) in the fibrous web, the fibrous sheet material or a resulting document (60). FIG. 6 depicts the embodiment where a plurality of security devices applied as patches (63*a*, 63*b*), are applied in register with a watermark (61). A first patch (63*a*) is applied in latitudinal registration with the watermark (61), while a second patch (63*b*) is applied in longitudinal registration with the watermark (61). It is also contemplated that the security device (63*a*, 63*b*) is aligned with the watermark (61) such that at least one feature (not shown) in the patch (63*a*, 63*b*) is in register with the watermark (61) or other feature in the fibrous web, fibrous sheet material or resulting document (60). The document (50, 60) has edges (59, 69) which, although depicted here as a side of a parallelogram, may also be depicted in other shapes with other angles. The security devices (52*a*, 52*b*, 53, 63*a*, 63*b*) are applied to the fibrous web, fibrous sheet material or document such that it does not extend beyond the edge (59, 69) of the document (50, 60). In a preferred embodiment, the security device is disposed on the surface such that it is situated away from the edge, not touching.

EXAMPLES

Figure 7A:
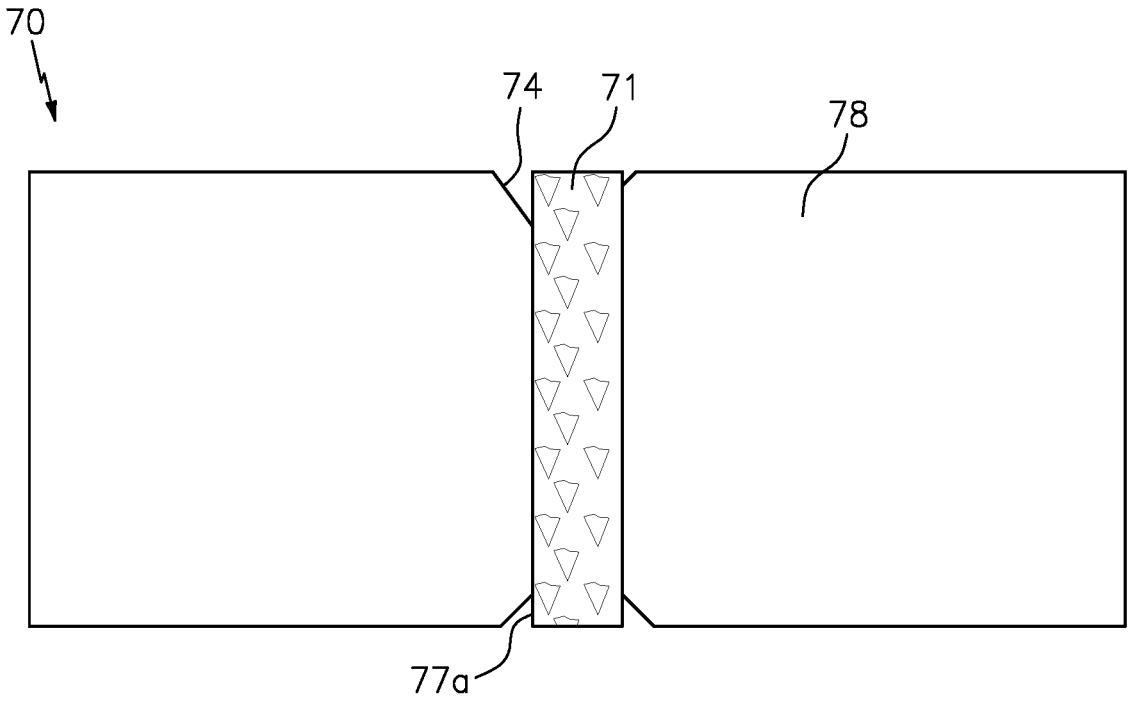
FIG. 7*a* is a plan view of the front side of a fibrous sheet material or document, produced by introducing the security device to a forming fibrous web during a wet stage of the paper manufacturing when the fibrous web is not sufficiently consolidated, after the fibrous sheet material or document has been subjected to one (1) cycle through a Circulation Simulation Test.

Comparative Example 1: Single Cycle Durability Test of Surface Applied Security Device when the Fibrous Web is not Sufficiently Consolidated In a first comparative example, a fibrous sheet material is made according to the conventional wet stage process where the security device is introduced to a fibrous web during the paper manufacturing process when the water and/or moisture content of the fibrous web is greater than 98%. As a result of fiber displacement, fibers in the hinge area (74) and in the sub-region are displaced resulting in decreased interaction of the security device (71) and the fibrous substrate (78) of the fibrous sheet material (70) in those areas. The fibrous sheet material (70) formed according to this process is depicted in FIG. 7*a*, after a single cycle (30 min.) through the Circulation Simulation Test. As a result of this single cycle, the fibrous sheet material (70) demonstrated poor durability, at least as defined by the development of a hinge effect as shown in hinge area (74). The security device (71) is detached from the substrate (78) of the fibrous sheet material (70) at points along the interfacial edges (77*a*).

Figure 7B:
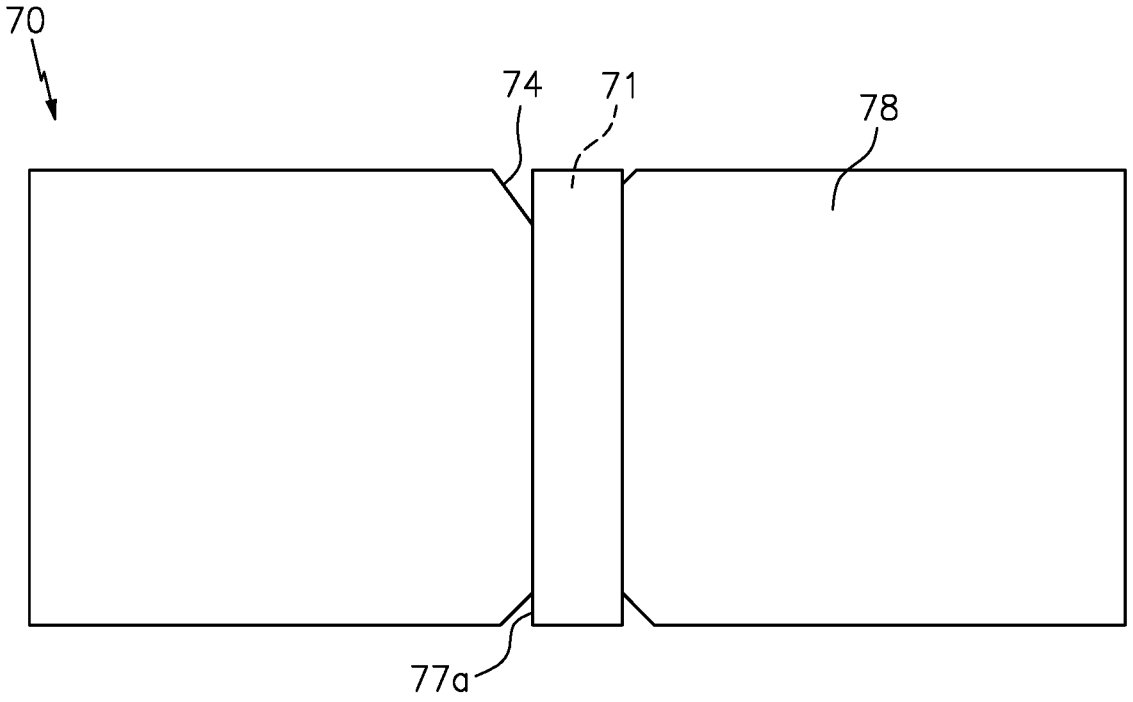
FIG. 7*b* is a plan view of the backside of a fibrous sheet material or document, produced by introducing the security device to the fibrous web during a wet stage of the paper manufacturing when the fibrous web is not sufficiently consolidated, after it has been subjected to one (1) cycle through a Circulation Simulation Test and show.

Moreover, the surface applied security device demonstrated backside show-through. A panel of five (5) persons (P1, P2, P3, P4, P5) were asked to rate the degree of backside show-through from 1 to 5, with 5 having the highest show-through and 1 having the least show-through. Panelists P1 and P4 rated the backside show-through as 4; panelist P2, P3 and P5 rated the backside show-through as 5. FIG. 7*b* depicts a fibrous sheet material (70) showing the backside show-through. This would require some kind of a backside camouflage coating to address this problem.

Cross-directional (CD) tensile strength of the fibrous sheet material was also measured using an INSTRON® tension tester, model 5965. A paper sample is cut to a dimension of 125 mm wide by 15 mm high with the thread running vertically through the center of the sample. The sample is then placed in the jaws of the Instron (model 5965) tensile tester with the jaws at a set with a 40 mm spacing between them and the thread centered in the gap. The sample is then elongated at a rate of 38 mm/minute until the sample breaks. This process is repeated 5 times and the average of the 5 values is the reported result of the test. The results showed that the CD tensile strength ranged from 5.4 to 6.3 kg.

Figure 8A:
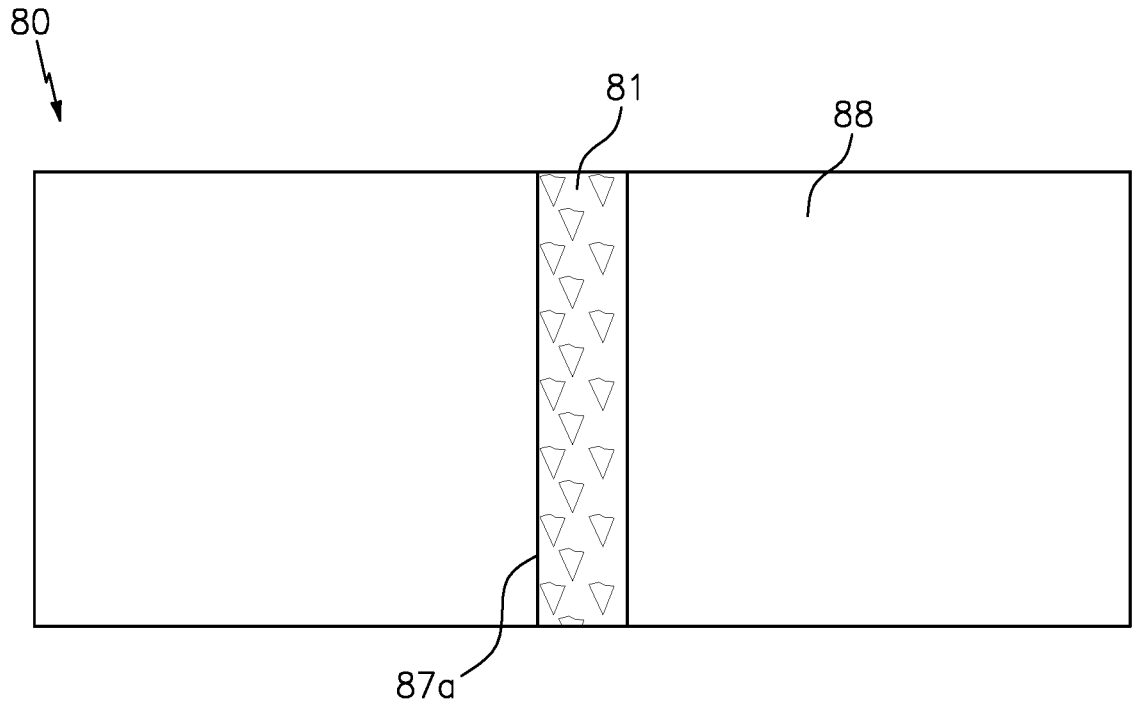
FIG. 8*a* is a plan view of the front side of an exemplary embodiment of a fibrous sheet material or document in accordance with the present invention, produced by introducing the security device to a forming fibrous web during a wet stage of the paper manufacturing when the fibrous web is sufficiently consolidated, after the fibrous sheet material or document has been subjected to one (1) cycle through a Circulation Simulation Test.

Inventive Example 1: Single Cycle Durability Test of Surface Applied Security Device when the Fibrous Web is Sufficiently Consolidated In a first inventive example, a fibrous sheet material (80) is made according to the invention disclosed herein where the security device (81) is introduced to a fibrous web during the paper manufacturing process when the moisture content of the fibrous web is less than 98%. As a result of reduced fiber displacement from the hinge area and increased fiber consolidation in the sub-region, there is sufficient interaction of the security device (81) with the substrate (88) of the fibrous sheet material (80). The fibrous sheet material (80) formed according to this process is depicted in FIG. 8*a*, after a single cycle through the Circulation Simulation Test. As is evident, the fibrous sheet material (80) has improved durability, relative to that produced in comparative example 1.

Here, the fibrous sheet material (80) shows no hinge effect and no damage or separation along the interfacial edge (87*a*) of the security device (81) and the substrate (88) of the fibrous sheet material (80). The fibrous sheet material (80) remains intact, demonstrating improved durability.

Figure 8B:
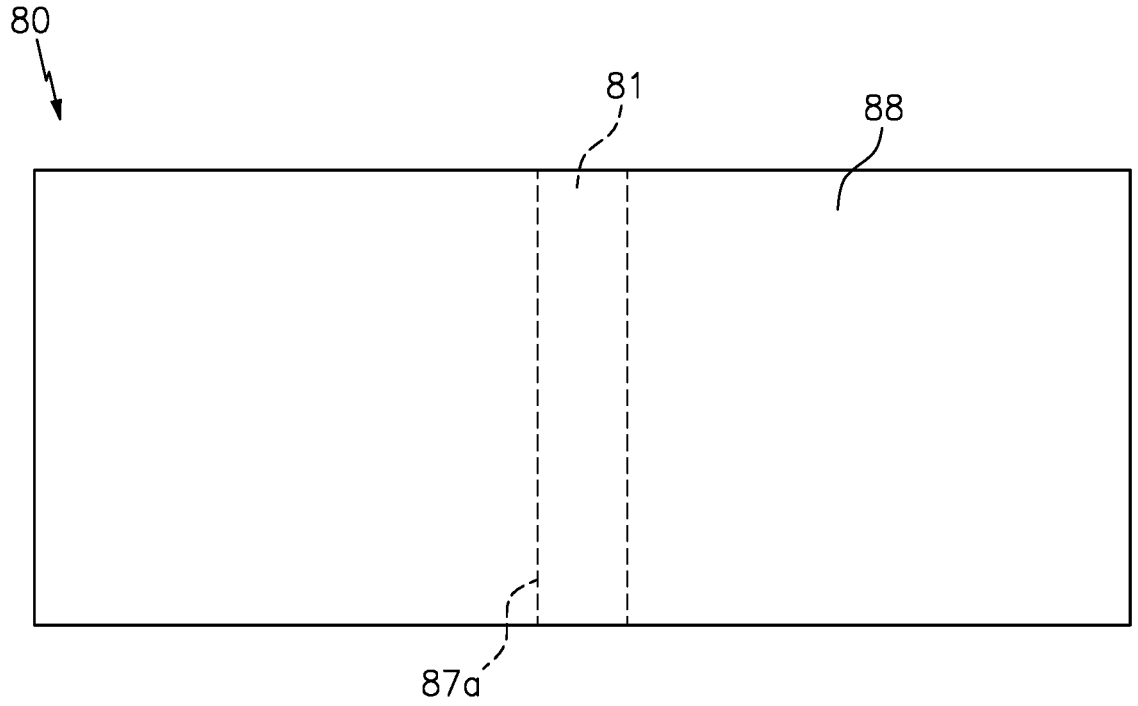
FIG. 8*b* is a plan view of the backside of an exemplary embodiment of a fibrous sheet material or document in accordance with the present invention, produced by introducing the security device to the fibrous web during a wet stage of the paper manufacturing when the fibrous web is sufficiently consolidated, after the fibrous sheet material or document has been subjected to one (1) cycle through a Circulation Simulation Test.
Figure 13:
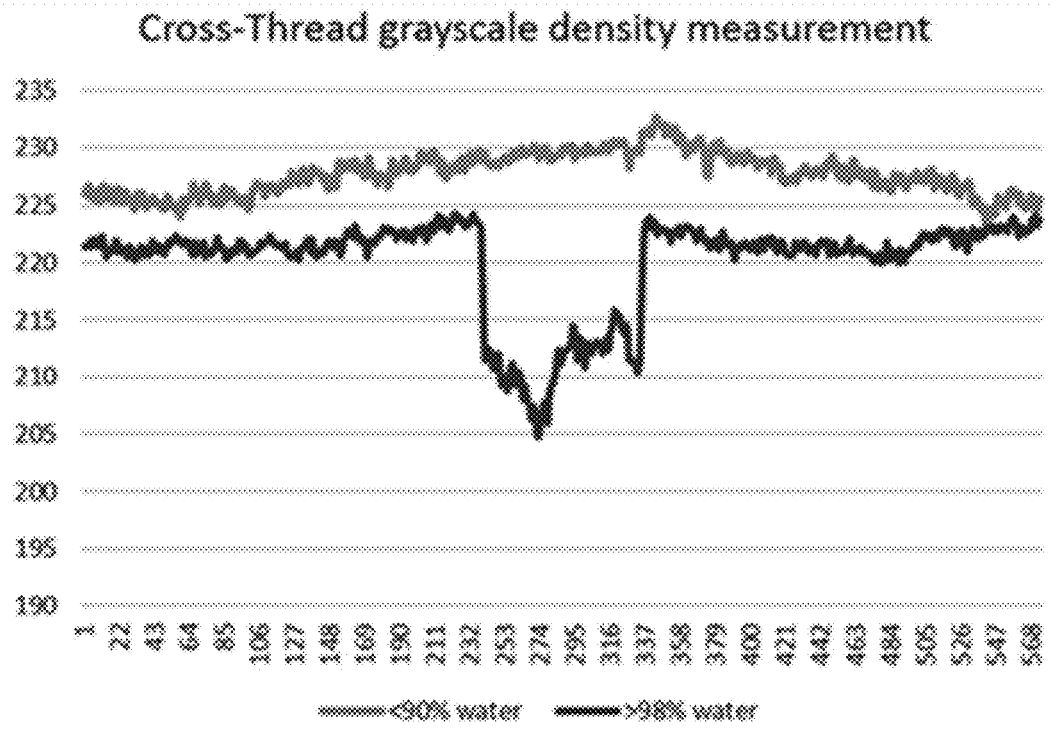
FIG. 13 illustrates a comparison of measured plot of cross-directional fiber densities between a comparison group and at least one embodiment according to this disclosure.

Moreover, the surface applied security device (81) demonstrated less backside show-through compared to comparative example 1. A panel of five (5) persons (P1, P2, P3, P4, P5) were asked to rate the degree of backside show-through from 1 to 5, with 5 having the highest show-through and 1 having the least show-through. Panelist P2 rated the backside show-through as 1; panelists P1, P3, P4 and P5 rated the backside show-through as 2. FIG. 8*b* depicts a fibrous sheet material showing the backside show-through. Alternatively, the backside show-through was characterized by measurement of cross-thread grayscale density. The paper sample was scanned on an Epson V750 perfection flatbed scanner which had been calibrated using an IT8 reference target. The paper was scanned at 600 dpi as a greyscale image in reflected light with a black background behind the sample. Once the scan is captured, a selected area density profile was generated. With this function, we select a region spanning the thread, where software captures the greyscale value for every pixel in the selected region, for this particular test, with the thread running vertically through the center of the selected region, the software averages the vertical pixels within the region and reports the vertical average data point for every horizontal pixel (e.g., if the region is 20 pixels high by 200 pixels wide, then for each horizontal position, the corresponding vertical pixel values would be averaged and would result in an output of 200 data points). The resulting data is then plotted in graph to show if there is any noticeable displacement in the greyscale values within the sampled area. The results of the density measurements are provided in FIG. 13. The results of the inventive example are provided by the top line while the results of the comparative example are provided in the lower line, indicating a substantial dip in the fiber density measurement as the measurement device traverses the opposing side of the security device. Lower values indicate high backside show-through. As can be seen, with the inventive method (<90% water and/or moisture), the density values across the fibrous sheet material remain relatively constant while for the comparative examples (>98% water and/or moisture), the density values take a recognized and substantial decrease in values. The mean cross-thread grayscale density for the comparative examples (>98% water) is 214; while the mean cross-thread grayscale density for the inventive examples (<90% water) is 226.

Cross-directional (CD) tensile strength of the fibrous sheet material (80) was also measured using an INSTRON® tension tester, model 5965. The same process as above was repeated here. The results showed that the CD tensile strength was better than that demonstrated in comparative example 1. Results of the comparative example are depicted as the first bars (>98% water) in FIG. 14, while results of the inventive example (<90% water) are depicted as the second bars in FIG. 14.

Figure 9A:
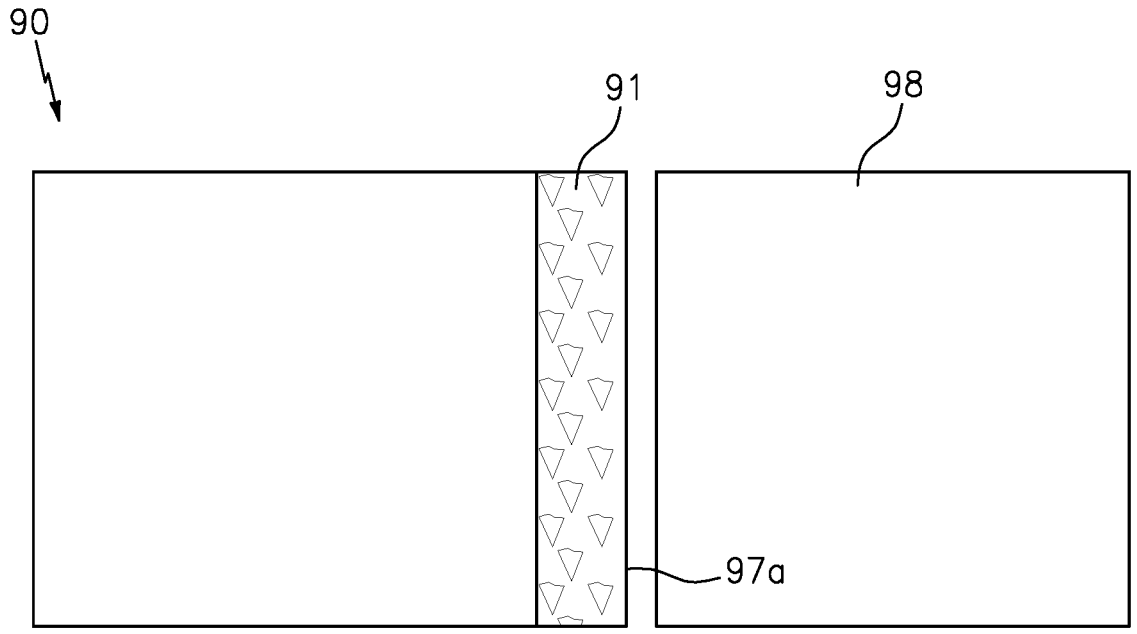
FIG. 9*a* is a plan view of the front side of a fibrous sheet material or document, produced by introducing the security device to a forming fibrous web during a wet stage of the paper manufacturing when the fibrous web is not sufficiently consolidated, after the fibrous sheet material or document has been subjected to three (3) cycles through a Circulation Simulation Test.

In a second comparative example, a fibrous sheet material (90) is made according to the conventional wet stage process where the security device is introduced to a fibrous web during the paper manufacturing process when the moisture content of the fibrous web is greater than 98%. As a result of fiber displacement, fibers in the hinge area and in the sub-region are displaced during introduction of the security device (91) resulting in decreased interaction of the security device (91) and the substrate (98) of the fibrous sheet material (90) in those areas. The fibrous sheet material (90) formed according to this process is depicted in FIG. 9*a*, after three cycles through the Circulation Simulation Test. As a result of these three cycles, the fibrous sheet material (90) demonstrated poor durability, at least as defined by the development of a tear in the sheet material along interfacial edge (97*a*). The fibrous sheet material (90) is torn in two pieces along the interfacial edge (97*a*).

Figure 9B:
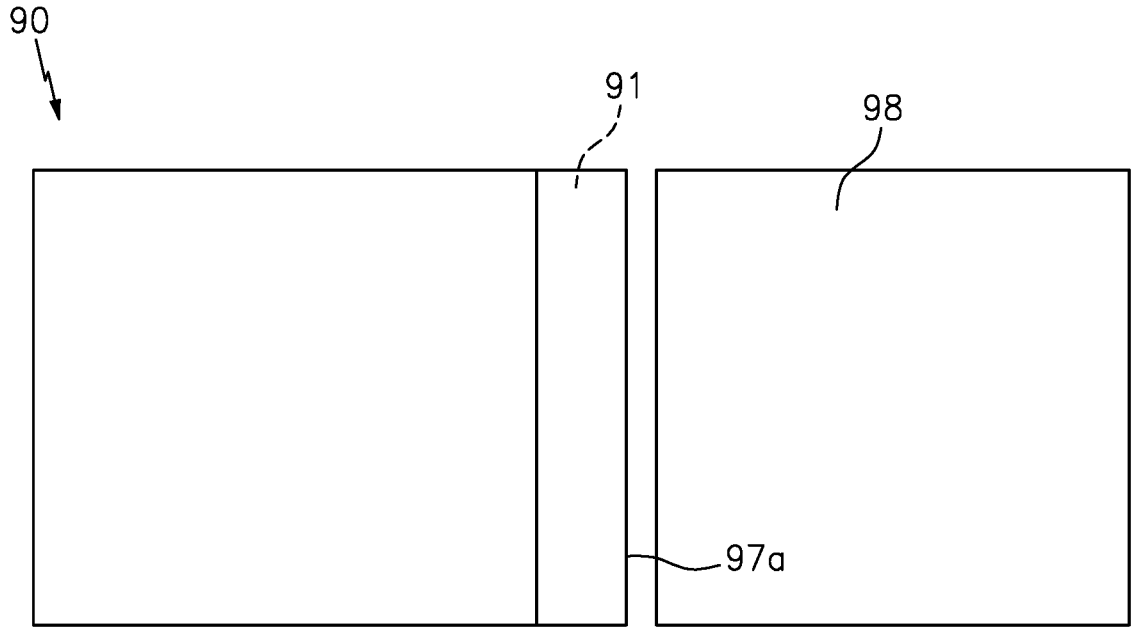
FIG. 9*b* is a plan view of the backside of a fibrous sheet material or document, produced by introducing the security device to a forming fibrous web during a wet stage of the paper manufacturing when the fibrous web is not sufficiently consolidated, after the fibrous sheet material or document has been subjected to three (3) cycles through a Circulation Simulation Test.

Moreover, the surface applied security device (91) demonstrated backside show-through. A panel of five (5) persons (P1, P2, P3, P4, P5) were asked to rate the degree of backside show-through from 1 to 5, with 5 having the highest show-through and 1 having the least show-through. Panelists P1 and P5 rated the backside show-through as 5; panelist P2, P3 and P4 rated the backside show-through as 4. FIG. 9*b* depicts a fibrous sheet material (90) showing the tear and backside show-through. This would require some kind of a backside camouflage coating to address this problem.

Figure 10A:
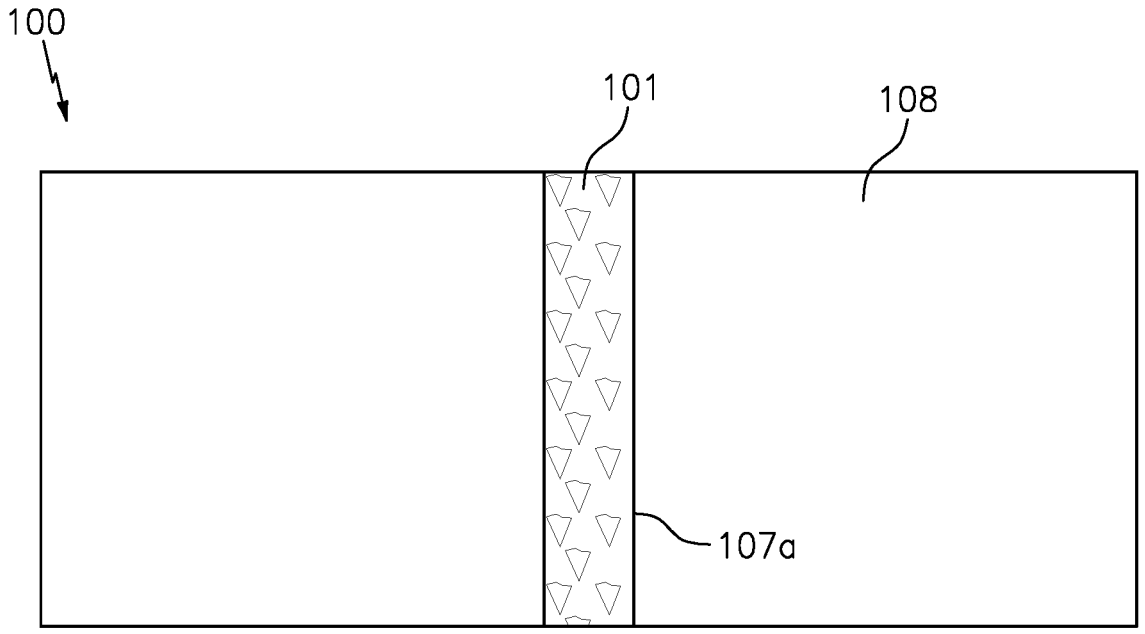
FIG. 10*a* is a plan view of the front side of an exemplary embodiment of a fibrous sheet material or document in accordance with the present invention, produced by introducing the security device to the fibrous web during a wet stage of the paper manufacturing when the fibrous web is sufficiently consolidated, after the fibrous sheet material or document has been subjected to three (3) cycles through a Circulation Simulation Test.

Inventive Example 2: Three Cycle Durability Test of Surface Applied Security Device when the Fibrous Web is Sufficiently Consolidated In a second inventive example, a fibrous sheet material (100) is made according to the invention disclosed herein where the security device (101) is introduced to a fibrous web during the paper manufacturing process when the moisture content of the fibrous web is less than 98%. As a result of reduced fiber displacement from the hinge area and increased fiber consolidation in the sub-region, relative to that in comparative example 1, there is sufficient interaction of the security device with the substrate (108) of the fibrous sheet material (100). The fibrous sheet material (100) formed according to this process is depicted in FIG. 10*a*, after three cycles through the Circulation Simulation Test. As is evident, the fibrous sheet material (100) has improved durability, relative to that produced in comparative example 2. Here, the fibrous sheet material (100) shows little to no hinge effect or damage along the interfacial edge (107*a*) of the security device (101) and the substrate (108) of the fibrous sheet material (100). The fibrous sheet material (100) remains intact, demonstrating improved durability.

Figure 10B:
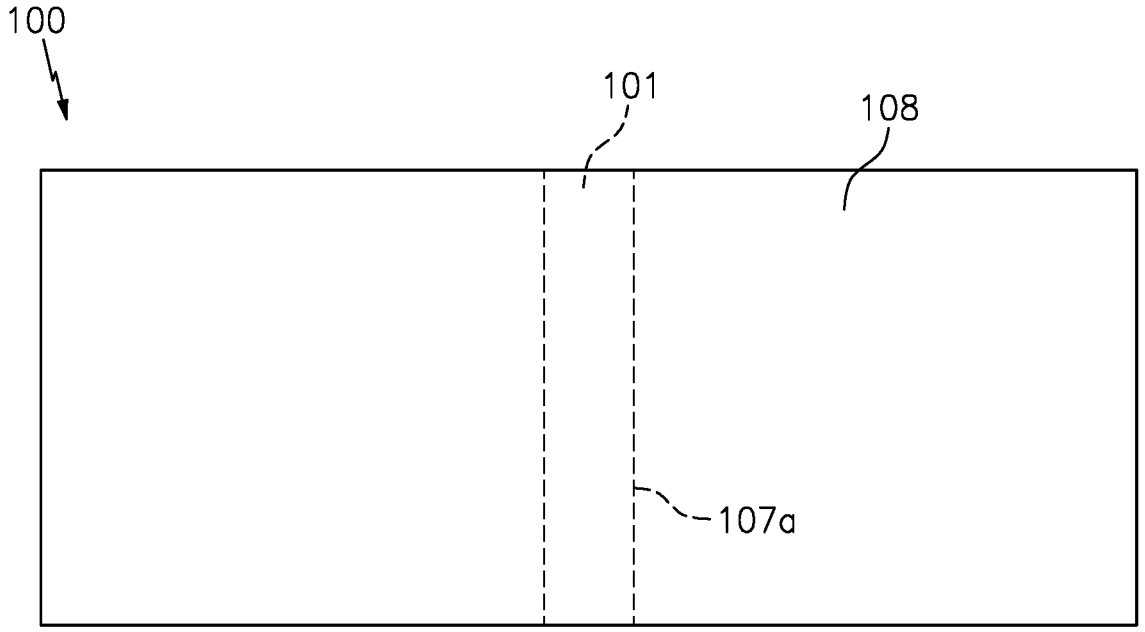
FIG. 10*b* is a plan view of the backside of an exemplary embodiment of a fibrous sheet material or document in accordance with the present invention, produced by introducing the security device to the fibrous web during a wet stage of the paper manufacturing when the fibrous web is sufficiently consolidated, after the fibrous sheet material or document has been subjected to three (3) cycles through a Circulation Simulation Test.

Moreover, the surface applied security device (101) demonstrated less backside show-through compared to comparative example 2. A panel of five (5) persons (P1, P2, P3, P4, P5) were asked to rate the degree of backside show-through from 1 to 5, with 5 having the highest show-through and 1 having the least show-through. Panelist P1 rated the backside show-through as 2; P2, P4 and P5 rated the backside show-through as 1; and panelist P3 rated the backside show-through as 3. FIG. 10*b* depicts a fibrous sheet material showing the improved backside show-through.

Figure 11:
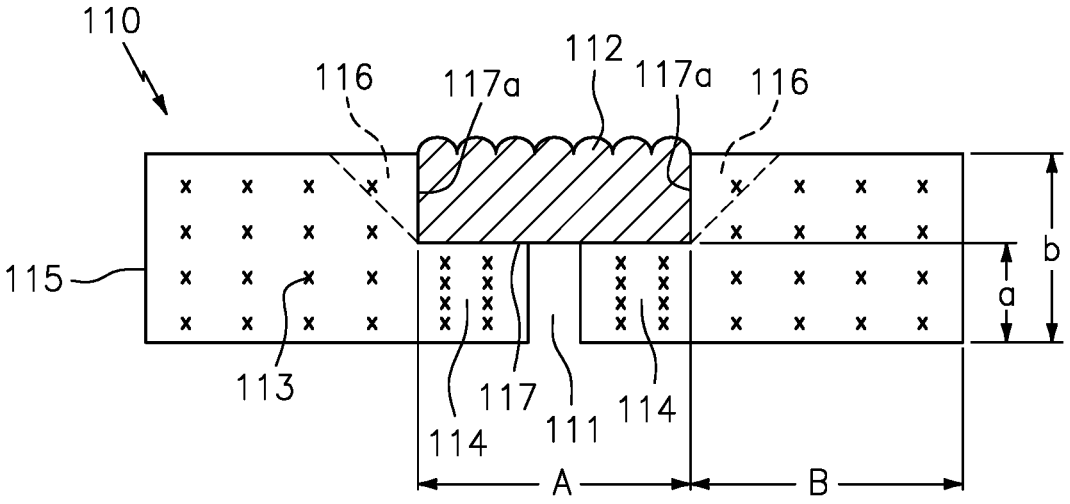
FIG. 11 is a cross-sectional side view of another exemplary embodiment of the fibrous sheet material of the present invention (the second aspect) produced by introducing the security device into a fibrous web having opposing surfaces and a paper machine made or 'soft-edged' through-hole. The security device is introduced into or onto the fibrous web once the fibrous web is sufficiently consolidated.

FIG. 11 depicts one embodiment of the second aspect of the present invention. Here, the fibrous sheet material is marked with reference number 110. A 'soft-edged' through-hole (111) is formed into the fibrous sheet material (110) in a wet stage of paper manufacture before the fibrous sheet material (110) becomes sufficiently consolidated. A security device (112) is then introduced over through-hole (111) when the fibrous sheet material is sufficiently consolidated such that a substantial amount of fibers (113) are not displaced from sub-region (114) when the security device is pressed into substrate (115) of the fibrous sheet material (110). Rather, the fibers (113) are further consolidated or densified under the security device (112) in the sub-region (114) delineating the through-hole (111) and in hinge area (116). This results in strong fiber interactions at interface (117) and particularly at interfacial edges (117*a*). Moreover, since the security device (112) is introduced during the wet stage, it can be pressed into the substrate (115) to provide a low caliper differential. Further, since the fibers are not displaced at this state, further consolidating in the sub-region (114) greatly reduces (if not eliminates) the possibility of the through-hole (111) becoming occluded or blocked.

Figure 12:
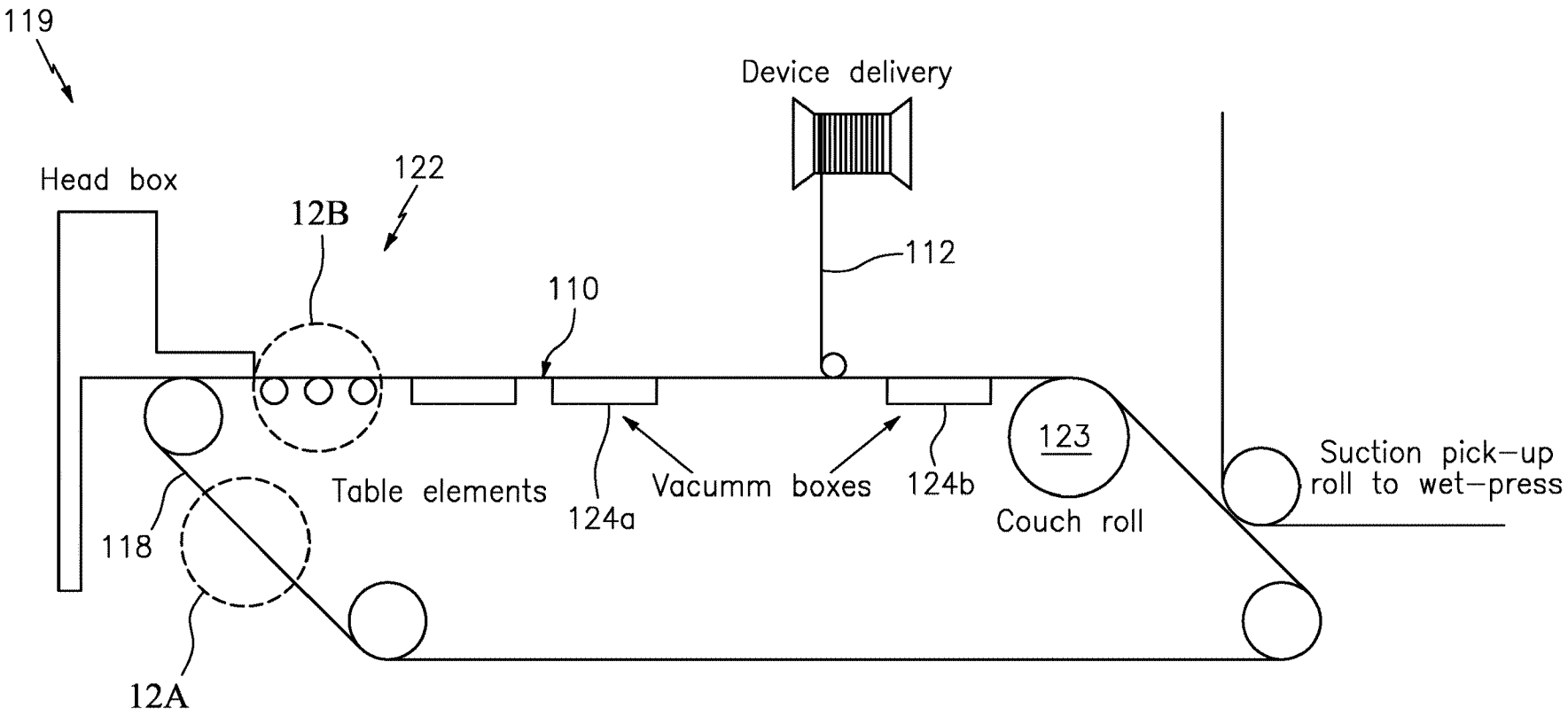
FIG. 12 is a schematic diagram of a Fourdrinier paper machine where through-holes are introduced in the forming fibrous web using a patterned forming wire and then the security device, in the form of a continuous web, is introduced to the fibrous web after the wet line and before the couch roll. The patterned forming wire is depicted in FIG. 12A before paper stock is discharged from a head box onto the forming wire, while the same forming wire is depicted in FIG. 12B after paper stock has been discharged onto the wire.
Figure 12A:
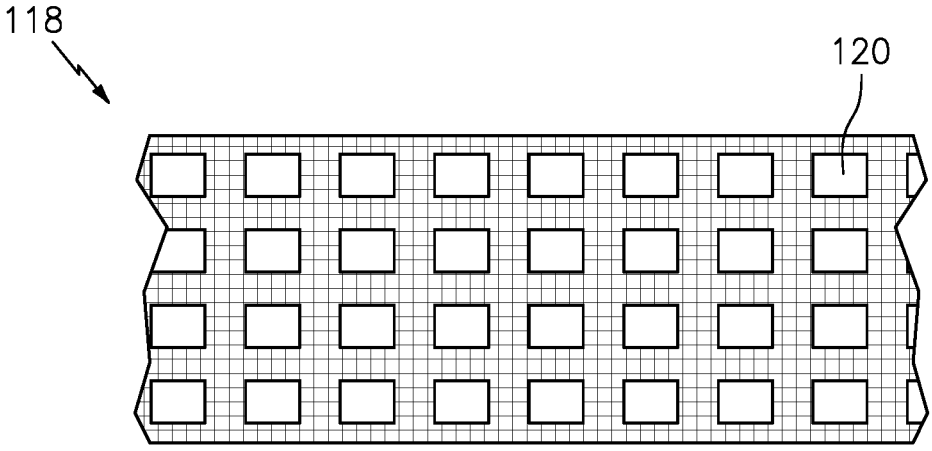
Figure 12B:
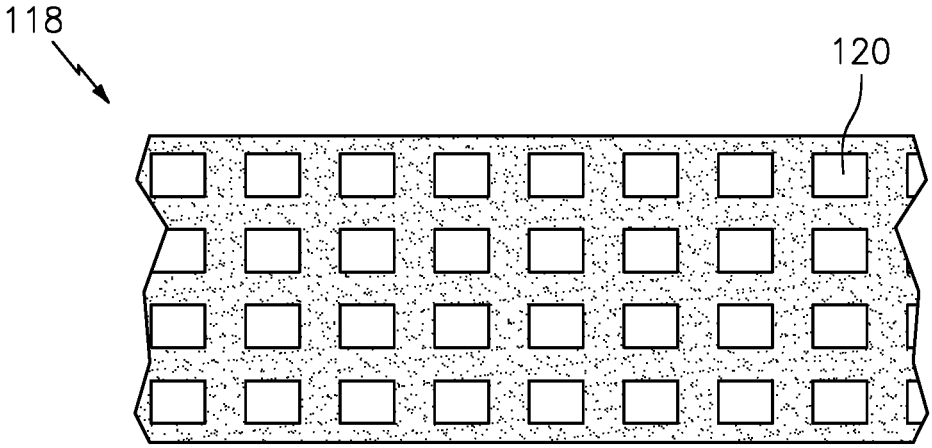

As noted above, the through-hole (111) and security device (112) may be introduced to the fibrous sheet material (110) using various methods and techniques. In particular, the screen of the paper machine may be a continuously moving forming wire of a Fourdrinier paper machine or a cylinder of a cylinder mold paper machine. In a preferred embodiment, which is shown in FIGS. 12, 12A, 12B, the through-hole (111) is formed using a patterned forming wire (118) on a Fourdrinier paper machine (119) provided with at least one water-impermeable element (120), which prevents sheet formation in this area. The patterned forming wire (118) is depicted before (FIG. 12A) and after (FIG. 12B) paper stock is discharged from the head box onto the forming wire. As shown in FIG. 12B, sheet formation is prevented in the area of the water-impermeable elements (120). After the through-holes (111) are formed and the fibrous sheet material (110) becomes sufficiently consolidated, the security device (112) is presented in the form of a continuous web and continuously applied to the forming fibrous sheet material (110) directly after the wet line (122) and before couch roll (123), and between vacuum boxes (124*a*, 124*b*), which help set the security device into the fibrous sheet material (110).

While various embodiments of the present invention have been described above it should be understood that they have been presented by way of example only, and not limitation. Thus, the breadth and scope of the present invention should not be limited by any of the exemplary embodiments.

The invention claimed is:

1. A fibrous sheet material having opposing surfaces, a recess in one opposing surface, and one or more through-holes that extend from the recess through an opposing surface of the fibrous sheet material, wherein the one or more through-holes are soft-edged through-holes, the fibrous sheet material comprising:

a fibrous sub-region that is disposed beneath the recess and that surrounds the one or more through-holes, and an immediate adjoining bulk region disposed next to the recess and the fibrous sub-region;

a surface applied security device disposed in the recess over the one or more through-holes; and an interface between the surface applied security device and the fibrous sub-region and bulk region, wherein fibers in the fibrous sub-region are further consolidated such that an amount of fibers in the fibrous sub-region is substantially equivalent to the amount of fibers in at least the immediate adjoining bulk region.

2. The fibrous sheet material of claim 1, wherein the one or more soft-edged through-holes comprise one or more of: distinctive irregularities in an edge region, a maximum diameter or width ranging from 4 to 15 microns, or a shape selected from a group comprising circular, oval, star-shaped, parallelogram and trapezium shapes.

3. The fibrous sheet material of claim 2, wherein the shape or outline contour of the one or more soft-edged through-holes match with at least one of the shape or outline contour of the surface applied security device, or an image displayed or projected by the surface applied security device.

4. The fibrous sheet material of claim 1, wherein the surface applied security device is formed from a structural film, the surface applied security device having a thickness of at least 10 microns.

5. The fibrous sheet material of claim 1, wherein the surface applied security device has a thickness ranging from 10 to 75 microns, or wherein the surface applied security device has a caliper differential that ranges from 10 to 25 microns.

6. The fibrous sheet material of claim 1, wherein the fibrous sheet material demonstrates at least one of (a) improved durability characterized by at least one of minimal damage at the interface, or almost no hinge effect, when subjected to at least one durability test cycle, or (b) acceptable ink adhesion, or (c) improved CD tensile strength, or (d) minimal or no show-through.

7. The fibrous sheet material of claim 1, wherein a density of fibers in the fibrous sub-region is greater than the density of fibers in at least the immediate adjoining bulk region.

8. The fibrous sheet material of claim 1, wherein the surface applied security device comprises an array of focusing elements, and an array of image icons that optically interact with focusing elements of the array of focusing elements to produce at least one synthetic image.

9. The fibrous sheet material of claim 1, wherein the surface applied security device comprises a stripe or a patch.

10. The fibrous sheet material of claim 1, wherein the surface applied security device is in register with at least one other feature on or within the fibrous sheet material.

11. The fibrous sheet material of claim 10, wherein the at least one other feature comprises one or more of a watermark, a printed image, a relief structure, a fiber or set of fibers, or another surface applied security device.

12. The fibrous sheet material of claim 1, wherein the fibrous sheet material is a banknote, and wherein the surface applied security device comprises an array of focusing elements, and an array of image icons that optically interact with focusing elements of the array of focusing elements to produce at least one synthetic image, wherein a thickness of the fibrous sub-region is less than a thickness of a fibrous bulk region such that a recess with a sidewall is formed in a surface of the fibrous sheet material, wherein the surface applied security device is disposed within the recess, wherein the surface applied security device has a thickness ranging from 10 to 10 microns and a caliper differential ranging from 0 to 15 microns, and wherein the surface applied security device is a stripe or patch exposed on at least one side of the banknote.

13. A method for surface application of a surface applied security device to a forming fibrous web of a fibrous sheet material, comprising:

forming one or more soft-edged through-holes in the forming fibrous web during paper manufacturing;

introducing the surface applied security device into or onto the forming fibrous web over the one or more through-holes, at a point of introduction, during paper manufacturing; and further consolidating fibers in a sub-region of the fibrous sheet material such that an amount of fibers in the sub-region is substantially equivalent to the amount of fibers in at least an immediate adjoining bulk region of the forming fibrous web.

14. The method of claim 13, wherein the one or more soft-edged through-holes are formed in the forming fibrous web of the fibrous sheet material during paper manufacturing before the forming fibrous web becomes sufficiently consolidated, such that a moisture level is greater than 98% by weight, based on a total weight of the forming fibrous web.

15. The method of claim 13, wherein the forming fibrous web is sufficiently consolidated, at least at the point of introduction, that a moisture level is less than 98% by weight, based on a total weight of the forming fibrous web, when the surface applied security device is introduced.

16. The method of claim 13, wherein the forming fibrous web is sufficiently consolidated that a moisture level is less than about 95% by weight, based on a total weight of the forming fibrous web.

17. The method of claim 13, wherein the surface applied security device is first presented as a continuous web that is then cut and placed into or onto the forming fibrous web, or wherein the surface applied security device introduced into or onto the forming fibrous web as a stripe or patch, or wherein the surface applied security device is introduced such that it is in register with at least one other feature on or within the fibrous sheet material or a document comprising the fibrous sheet material.

18. The method of claim 13, further comprising:

providing the surface applied security device as a continuous web; and cutting or punching the continuous web in a continuous manner to form patches or stripes;

wherein application of the surface applied security device comprises continuous introduction of the patches or stripes to the forming fibrous web over the one or more soft-edged through-holes such that a fibrous bulk region, a fibrous sub-region and a negative relief having a sidewall, are formed in the forming fibrous web; and wherein application of the surface applied security device further consolidates fibers in the sub-region such that an amount of fibers in the sub-region are substantially equivalent to the amount of fibers in at least the immediate adjoining bulk region.

19. The method of claim 13, further comprising continuously adjusting a point of introduction of the surface applied security device by modulating a tension on the forming fibrous web.

* * * * *